US009933725B2

(12) United States Patent
Fukasawa et al.

(10) Patent No.: US 9,933,725 B2
(45) Date of Patent: Apr. 3, 2018

(54) DEVELOPING DEVICE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Yu Fukasawa, Yokohama (JP); Hideki Maeshima, Mishima (JP); Kuniaki Hirukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/444,111

(22) Filed: Feb. 27, 2017

(65) Prior Publication Data

US 2017/0168420 A1 Jun. 15, 2017

Related U.S. Application Data

(63) Continuation of application No. 15/299,336, filed on Oct. 20, 2016, now Pat. No. 9,618,880, which is a continuation of application No. 14/029,607, filed on Sep. 17, 2013, now Pat. No. 9,535,370.

(30) Foreign Application Priority Data

Sep. 20, 2012 (JP) ..... 2012-207526

(51) Int. Cl.
*G03G 15/08* (2006.01)
*G03G 21/18* (2006.01)

(52) U.S. Cl.
CPC ..... *G03G 15/0865* (2013.01); *G03G 21/18* (2013.01)

(58) Field of Classification Search
CPC ..... G03G 15/0891; G03G 15/556; G03G 21/1814; G03G 2215/0132; G03G 2215/0894
See application file for complete search history.

(56) References Cited

U.S. PATENT DOCUMENTS 9,746,798 B2 * 8/2017 Sato ..... G03G 15/0812
2006/0034644 A1 * 2/2006 Ishii ..... G03G 15/0875 399/263
2009/0274491 A1 * 11/2009 Sato ..... G03G 15/0896 399/281
2011/0123205 A1 * 5/2011 Satomura ..... G03G 15/0856 399/27

FOREIGN PATENT DOCUMENTS

JP 2009134051 A * 6/2009

* cited by examiner

*Primary Examiner* — Francis Gray
(74) *Attorney, Agent, or Firm* — Canon U.S.A., Inc. IP Division

(57) ABSTRACT

A developing device includes a developer storage chamber configured to store developer to be supplied to the development chamber, a partition configured to separate a development chamber and the developer storage chamber and having an opening allowing communication between the developer storage chamber and the development chamber, and a protruding portion configured to protrude toward the inside of the developer storage chamber from the partition on a downstream side of the opening in the rotation direction of a rotating shaft, and within one turn of rotation of the rotating shaft, a receiving member moves while contacting the protruding portion according to the rotation of the rotating shaft.

15 Claims, 15 Drawing Sheets

DEVELOPING DEVICE, PROCESS CARTRIDGE, AND ELECTROPHOTOGRAPHIC IMAGE FORMING APPARATUS

CROSS REFERENCE TO RELATED APPLICATIONS

This application is a Continuation of U.S. patent application Ser. No. 15/299,336, filed Oct. 20, 2016, which is a Continuation of U.S. Pat. No. 9,535,370, issued Jan. 3, 2017, which claims the benefit of Japanese Patent Application No. 2012-207526 filed Sep. 20, 2012, all of which are hereby incorporated by reference herein in their entireties.

BACKGROUND OF THE INVENTION

Field of the Invention

The present invention relates to a developing device used in an electrophotographic image forming apparatus, a process cartridge including the developing device, and the electrophotographic image forming apparatus.

The electrophotographic image forming apparatus forms an image on a recording material according to an electrophotographic image forming process. The electrophotographic image forming apparatus is, for example, a copying machine, a printer (e.g., laser beam printer, LED printer), a facsimile machine, or a word processor.

The developing device visualizes an electrostatic image formed on an electrophotographic photosensitive member (photosensitive member) by the electrophotographic image forming process using developer.

The process cartridge generally includes a photosensitive member and process units, which act on the photosensitive member, in an integrated manner. The process cartridge is removable from the apparatus main body of the electrophotographic image forming apparatus. The process units include, for example, a charging unit, a developing unit, and a cleaning unit. According to the present invention, the process cartridge is a cartridge including a photosensitive member and at least a developing device in an integrated manner, and is removable from the apparatus main body of the electrophotographic image forming apparatus.

Description of the Related Art

Among the electrophotographic image forming apparatuses using the electrophotographic image forming process, there is an image forming apparatus employing the process cartridge method. The electrophotographic image forming apparatus employing the process cartridge method uses a cartridge removable from the apparatus main body of the electrophotographic image forming apparatus. The cartridge includes a photosensitive member and process units that act on the photosensitive member in an integrated manner. Since the user of such an image forming apparatus can perform maintenance of the apparatus by herself/himself without help from a service engineer, operability is significantly improved.

Generally, as development methods of a developing device of an electrophotographic image forming apparatus, there are methods such as a contact development method and a contactless development method. Whereas the development is performed in a state where a developer bearing member contacts the photosensitive member according to the contact development method, the development is performed in a state where a predetermined space exists between the developer bearing member and the photosensitive member according to the contactless development method. Further, as a method for supplying developer to the developer bearing member, Japanese Patent Application Laid-Open No. 2010-009021 discusses a method that supplies developer from a developer storage chamber to a development chamber by a conveyance member. According to this method, the developer is supplied via an opening formed in a partition that separates the developer storage chamber storing developer and the development chamber provided with the developer bearing member.

According to this method, the conveyance member is attached to a rotating shaft, which is rotatable and located in the developer storage chamber. The developer supplied to the development chamber by the conveyance member is rubbed by a developer supplying member for supplying developer to the developer bearing member, and a developer regulation member, which controls the amount of developer bore by the developer bearing member, and bore by the developer bearing member. The developer which is not bore by the developer bearing member is accumulated in the development chamber. When the amount of the accumulated developer reaches a predetermined amount, the developer is spilled out from the development chamber via the above-described opening, and returns to the developer storage chamber. The developer inside the development chamber may be deteriorated due to friction. However, if the developer is returned from the development chamber to the developer storage chamber and is mixed with the developer in the developer storage chamber, the deteriorated developer inside the development chamber will not be accumulated to an amount more than an acceptable level, and the developer in the development chamber and the developer inside the containing chamber can circulate.

On the other hand, in order to provide remaining developer level information to the user and prompt the user to smoothly replace the process cartridge, the amount of developer that remains in the developer storage chamber is detected. As one method for detecting the amount of developer, there is a method called developer amount detection method using light transmission. This method is discussed in Japanese Patent Application Laid-Open Nos. 2010-009021 and 2003-131479.

According to this method, detection light emitted from a light emitting unit, such as a light-emitting diode (LED), attached to, for example, the main body of the electrophotographic image forming apparatus is guided to the inside of the developer storage chamber via a light guide and a light transmission window attached to the developer storage chamber. The detection light incident on the inside of the developer storage chamber is output from the developer storage chamber via the light transmission window (or, for example, via a reflection mirror) depending on the amount of developer in the developer storage chamber. Then, by a light guide attached to the developer storage chamber, the detection light is guided to a light-receiving unit such as a photo transistor attached to the apparatus main body.

According to the method discussed in Japanese Patent Application Laid-Open No. 2010-009021, the detection light is blocked by the developer scooped by the conveyance member provided in the developer storage chamber in a rotatable manner. Since the transmission time of light is increased when the amount of developer that remains inside the developer storage chamber is reduced, the amount of developer in the developer storage chamber can be estimated according to the transmission time of the detection light.

If the rotation speed of the conveyance member is increased to realize high speed printing of the electrophotographic image forming apparatus, the developer may be dumped from the conveyance member when it is conveyed and scattering of the developer may occur inside the developer storage chamber. If the developer is scattered inside the developer storage chamber, the detection light will be blocked by the scattered developer, and the detection accuracy of the developer amount detection method using light transmission may be reduced.

According to the method discussed in Japanese Patent Application Laid-Open No. 2010-009021, a receiving member configured to receive the developer falling from the conveyance member is provided on a rotating shaft disposed in the developer storage chamber. The receiving member prevents the developer from being scattered in the developer storage chamber.

As described in the exemplary embodiments below, the length of the receiving member made of a flexible sheet member, such as the one discussed in Japanese Patent Application Laid-Open No. 2010-009021, can be increased so that the receiving member slides over the inner wall surface of the developer storage chamber. The length of the receiving member is the length in the rotation radial direction of the rotating shaft.

However, in this case, the opening formed in the partition that separates the developer storage chamber and the development chamber is temporarily blocked by the receiving member each time the rotating shaft rotates, and the travel of the developer from the development chamber to the developer storage chamber via the opening may be blocked. Thus, the circulation of the developer between the development chamber and the developer storage chamber may be temporarily blocked. If the circulation of the developer is temporarily blocked, due to friction between the developer and the developer supplying member or the developer regulation member, deterioration of the developer accumulated in the development chamber may be accelerated. This may adversely affect the image.

SUMMARY OF THE INVENTION

The present invention is directed to a developing device, a process cartridge, and an electrophotographic image forming apparatus which is useful in preventing blocking of developer circulation via an opening formed in a partition that separates a developer storage chamber and a development chamber.

According to an aspect of the present invention, A developing device used for an electrophotographic image forming apparatus, includes a developer bearing member configured to bear and convey developer used for developing an electrostatic image formed on an electrophotographic photosensitive member, a development chamber including the developer bearing member, a developer storage chamber configured to store developer to be supplied to the development chamber, a partition configured to separate the development chamber and the developer storage chamber and having an opening that allows communication between the developer storage chamber and the development chamber, a rotating shaft configured to be rotatable and provided inside the developer storage chamber, a conveyance member having an end portion on the inner side in a rotation radial direction of the rotating shaft attached to the rotating shaft, and according to rotation of the rotating shaft, configured to bear and convey the developer on a bearing surface, which is a surface on a downstream side in the rotation direction of the rotating shaft, and supply the developer to the development chamber via the opening, a receiving member having an end portion on the inner side in the rotation radial direction of the rotating shaft attached to the rotating shaft, and having flexibility configured to receive the developer falling from the bearing surface of the conveyance member on a downstream side of the conveyance member in the rotation direction of the rotating shaft according to the rotation of the rotating shaft, and a protruding portion configured to protrude toward the inside of the developer storage chamber from the partition on a downstream side of the opening in the rotation direction of the rotating shaft, wherein, within one turn of rotation of the rotating shaft, the receiving member moves while simultaneously contacting an inner wall surface of the developer storage chamber on an upstream side of the opening in the rotation direction of the rotating shaft and the protruding portion according to the rotation of the rotating shaft.

According to the present invention, a process cartridge and an electrophotographic image forming apparatus including the developing device described above are provided.

Further features of the present invention will become apparent from the following detailed description of exemplary embodiments with reference to the attached drawings.

DESCRIPTION OF THE EMBODIMENTS

Various exemplary embodiments, features, and aspects of the invention will be described in detail below with reference to the drawings.

Figure 1:
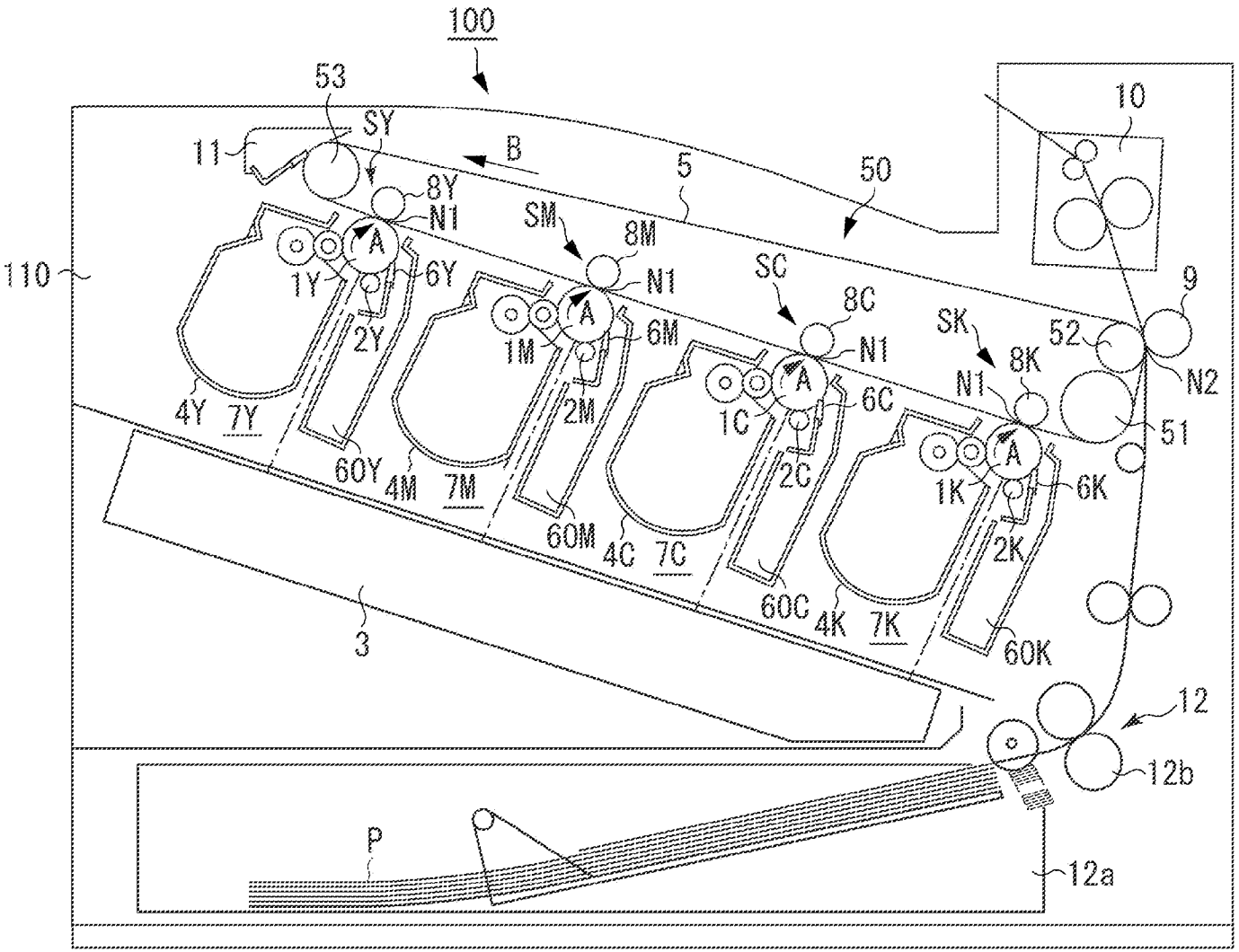
FIG. 1 is a schematic sectional view of an image forming apparatus according to a first exemplary embodiment of the present invention.

1. Overall Configuration and Operation of Electrophotographic Image Forming Apparatus First, an overall configuration and an operation of an electrophotographic image forming apparatus according to a first exemplary embodiment of the present invention will be described. FIG. 1 is a schematic cross-sectional view of an electrophotographic image forming apparatus 100 according to the present exemplary embodiment.

The electrophotographic image forming apparatus 100 according to the present exemplary embodiment is an in-line full-color laser beam printer employing the intermediate transfer method. The electrophotographic image forming apparatus 100 can form a full-color image on a recording material (recording medium) such as recording paper, a plastic sheet, and a fabric according to image information. The image information is input in an apparatus main body 110 from an image reading apparatus connected to the apparatus main body 110 of the electrophotographic image forming apparatus 100 or a host apparatus, such as a personal computer, communicably connected to the apparatus main body 110.

The electrophotographic image forming apparatus 100 includes a plurality of image forming units. They are a first image forming unit SY, a second image forming unit SM, a third image forming unit SC, and a fourth image forming unit SK which form color images of yellow (Y), magenta (M), cyan (C), and black (K), respectively. According to the present exemplary embodiment, the first to the fourth image forming units SY, SM, SC, and SK are arranged in a line in a direction that intersects with the vertical direction.

According to the present exemplary embodiment, the configurations and operations of the first to the fourth image forming units SY, SM, SC, and SK are substantially the same except that the color of toner used as the developer is different. In the description below, suffixes Y, M, C, and K, which denote the colors of the components, are not used unless otherwise necessary, and the description thereof is made collectively.

The image forming units SY, SM, SC, and SK includes photosensitive drums 1Y, 1M, 1C, and 1K, respectively. Each photosensitive drum is a drum-type electrophotographic photosensitive member (photosensitive member) as an image bearing member. The four photosensitive drums 1Y, 1M, 1C, and 1K of the image forming units SY, SM, SC, and SK are arranged in a direction that intersects the vertical direction. By rotation driving of a drive motor (not illustrated) as a driving unit (drive source), each of the photosensitive drums 1Y, 1M, 1C, and 1K moves in the direction (clockwise) indicated by an arrow A.

Various units are provided around the photosensitive drum 1. A charge roller 2, which is a roller-type charging member as a charging unit, uniformly charges the surface of the photosensitive drum 1. A scanner unit 3 including an exposure device and an optical system, which is an exposure unit, forms an electrostatic image (electrostatic latent image) on the photosensitive drum 1 by emitting a laser beam based on image information. A developing device (developing unit) 4 develops the electrostatic image formed on the photosensitive drum 1 as a toner image. A transfer device (transfer unit) 50 transfers the toner image formed on the photosensitive drum 1 to a recording material P. A cleaning device (cleaning unit) 60 removes the toner that remains on the surface of the photosensitive drum 1 after the transfer.

The transfer device 50 includes an intermediate transfer belt 5 as an intermediate transfer member which is arranged to face each of the four photosensitive drums 1Y, 1M, 1C, and 1K. The intermediate transfer belt 5 is an endless belt which contacts all the photosensitive drums 1Y, 1M, 1C, and 1K and rotates cyclically in the direction indicated by an arrow B (counterclockwise). The intermediate transfer belt 5 is stretched and supported by a plurality of supporting members including a drive roller 51, a secondary transfer counter roller 52, and a driven roller 53. Four primary transfer rollers 8Y, 8M, 8C, and 8K as primary transfer members are arranged in a row on the inner periphery side of the intermediate transfer belt 5 to face the corresponding photosensitive drums 1Y, 1M, 1C, and 1K. The primary transfer roller 8 presses the intermediate transfer belt 5 against the photosensitive drum 1 to form a nip (primary transfer nip) at a primary transfer portion N1. A primary transfer bias power supply (high voltage power supply) (not illustrated) as a primary transfer bias application unit applies a bias of polarity opposite the normal charge polarity of the toner to the primary transfer roller 8. According to this application, the toner image on the photosensitive drum 1 is transferred (primary transferred) to the intermediate transfer belt 5. Further, a secondary transfer roller 9, as a roller-type secondary transfer member, is arranged on the outer periphery side of the intermediate transfer belt 5. The secondary transfer roller 9 faces the secondary transfer counter roller 52 with the intermediate transfer belt 5 therebetween. More specifically, the secondary transfer roller 9 presses the intermediate transfer belt 5 against the secondary transfer counter roller 52 to form a nip (secondary transfer nip) at a secondary transfer portion N2 where the intermediate transfer belt 5 contacts the secondary transfer roller 9. A secondary transfer bias power supply (high voltage power supply) (not illustrated) as a secondary transfer bias application unit applies a bias of polarity opposite the normal charge polarity of the toner to the secondary transfer roller 9. According to the bias application, the toner image on the intermediate transfer belt 5 is transferred (secondary-transferred) to the recording material P. The primary transfer roller 8 and the secondary transfer roller 9 have a similar configuration.

In addition, the electrophotographic image forming apparatus 100 includes a recording material supply device (recording material supply device) and a fixing device (fixing device) 10. The recording material supply device supplies the recording material P to the secondary transfer portion N2. The fixing device 10 is provided downstream of the secondary transfer portion N2 in the conveying direction of the recording material P. The fixing device 10 fixes a toner image to the recording material P.

A charging position of the charge roller 2, an exposure position of a scanner unit 3, a development position of the developing unit 4, a toner image transfer position of the intermediate transfer belt 5, a cleaning position of the cleaning device 60 are provided in this order in the rotation direction of the photosensitive drum 1.

According to the present exemplary embodiment, toner as nonmagnetic one-component developer is used as the developer. Further, according to the present exemplary embodiment, a developing roller 17 (see FIG. 2) as a developer bearing member in the developing unit 4 contacts the photosensitive drum 1 and develops the electrostatic image. Furthermore, according to the present exemplary embodiment, the developing unit 4 develops the electrostatic image by reversal development by which toner charged to the same polarity as the charge polarity of the photosensitive drum 1 (negative polarity according to the present exemplary embodiment) is adhered to a portion where the absolute value of the electric potential is reduced (imaging portion, exposure portion) by the exposure of the photosensitive drum 1.

According to the present exemplary embodiment, the photosensitive drum 1, the charge roller 2 as the process unit that acts on the photosensitive drum 1, the developing unit 4, and the cleaning device 60 are integrated to form a process cartridge 7. The process cartridge 7 can be mounted on and removed from the apparatus main body 110 via mounting members such as a positioning member and a mounting guide provided on the apparatus main body 110. According to the present exemplary embodiment, the process cartridges 7Y, 7M, 7C, and 7K, which have a same shape, contain toner of yellow (Y), magenta (M), cyan (C), and black (K), respectively.

When the image forming operation is performed, the surface of the photosensitive drum 1 is uniformly charged by the charge roller 2. Then, laser light (information light) is emitted from the scanner unit 3 according to image information and the surface of the photosensitive drum 1, which is charged, is scanned and exposed. In this manner, an electrostatic image, according to the image information, is formed on the photosensitive drum 1. Subsequently, the electrostatic image formed on the photosensitive drum 1 is developed as a toner image by the developing unit 4. The toner image formed on the photosensitive drum 1 is primary-transferred to the intermediate transfer belt 5 by the primary transfer roller 8.

When a full-color image is formed, the above-described process is sequentially performed with respect to the first to the fourth image forming units SY, SM, SC, and SK, and the toner image of each color is sequentially superimposed and primary transferred to the intermediate transfer belt 5.

Then, the recording material P is conveyed to the secondary transfer portion N2 by a conveyance roller 12*b* in synchronization with the movement of the toner image formed on the intermediate transfer belt 5. The recording material P is conveyed from a recording material cassette 12*a* of a recording material supply device 12. The recording material supply device 12 is included in a conveyance unit which conveys the recording material P. At the secondary transfer portion N2, the toner images of four colors on the intermediate transfer belt 5 are secondary-transferred to the recording material P by one operation by the secondary transfer roller 9 which contacts the intermediate transfer belt 5 via the recording material P.

The recording material P with the transferred toner image is conveyed to the fixing device 10. Then, the toner image is fixed to the recording material P according to the heat and pressure applied to the recording material P by the fixing device 10. When the fixing process is finished, the recording material P is discharged from the apparatus main body 110.

Primary transfer residual toner that remains on the photosensitive drum 1 after the primary transfer process is cleaned by the cleaning device 60. The cleaning device 60 collects the primary transfer residual toner removed from the surface of rotating the photosensitive drum 1 by a cleaning member 6 (see FIG. 2) and stores it in a removed toner chamber 14*a* (see FIG. 2). Further, secondary transfer residual toner that remains on the intermediate transfer belt 5 after the secondary transfer process is cleaned by an intermediate transfer belt cleaning device 11.

The electrophotographic image forming apparatus 100 can also form a single-color image or a multi-color image by using one or a plurality of image forming units.

2. Process Cartridge

Figure 2:
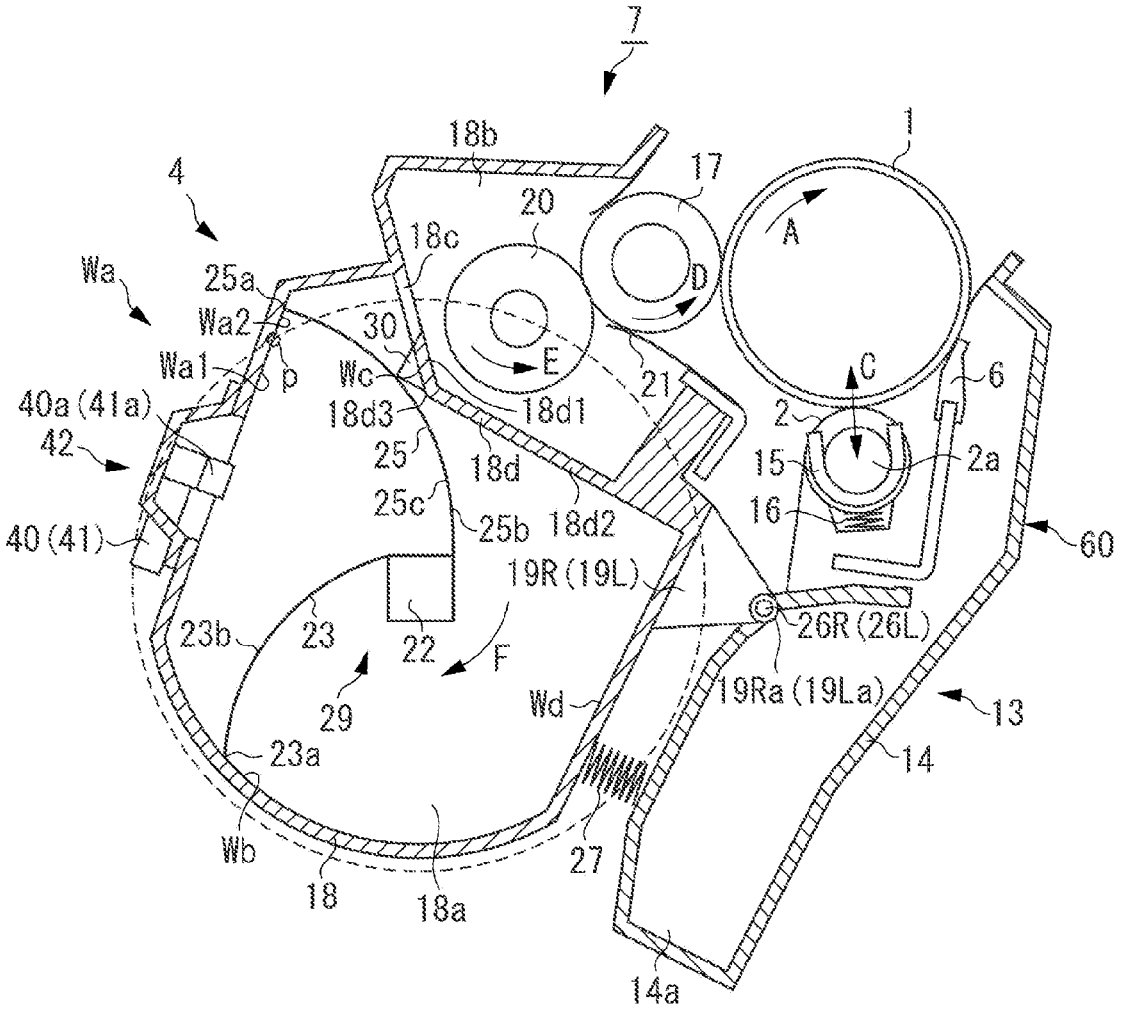
FIG. 2 is a longitudinal sectional view of a process cartridge according to the first exemplary embodiment of the present invention.

Next, the process cartridge 7 according to the present exemplary embodiment will be described. FIG. 2 is a longitudinal sectional view of the process cartridge 7 mounted on the apparatus main body 110.

According to the present exemplary embodiment, the process cartridge 7Y containing yellow toner, the process cartridge 7M containing magenta toner, the process cartridge 7C containing cyan toner, and the process cartridge 7B containing black toner have a substantially the same configuration.

The process cartridge 7 includes a photosensitive member unit 13 and the developing unit 4. Each unit is described below.

The photosensitive member unit 13 includes the photosensitive drum 1, the charge roller 2, and the cleaning device 60. The photosensitive drum 1, the charge roller 2, and the cleaning device 60 are integrated into the photosensitive member unit 13 with a cleaning frame body 14. The cleaning device 60 includes the cleaning member (cleaning blade) 6 and the removed toner chamber 14*a*. The removed toner chamber 14*a* is formed by the cleaning frame body 14. The photosensitive drum 1 is supported by the cleaning frame body 14 in a rotatable manner via a bearing (not illustrated). When the image forming operation is performed, the photosensitive drum 1 rotates in the direction indicated by the arrow A (clockwise) according to a driving force of the drive motor (not illustrated) as a driving unit in the apparatus main body 110. The charge roller 2 and the cleaning member 6 are arranged to contact the periphery of the photosensitive drum 1. The primary transfer residual toner removed from the surface of the photosensitive drum 1 by the cleaning member 6 drops in the removed toner chamber 14*a*.

A charge roller bearing 15 is fixed to the cleaning frame body 14 in such a manner that it can move in the direction indicated by a two-headed arrow C. The direction is along the line that connects the center of rotation of the charge roller 2 and the center of rotation of the photosensitive drum 1. A rotating shaft 2*a* of the charge roller 2 is supported by the cleaning frame body 14 in a rotatable manner via the charge roller bearing 15. The charge roller bearing 15 is pressed against the photosensitive drum 1 by a charge roller pressure application member 16.

The developing unit 4 is integrated in a developing frame body 18. A developer storage chamber 18*a* and a development chamber 18*b* are formed by the developing frame body 18. The developer storage chamber 18*a* contains toner as the developer. Further, a rotating shaft 22, a conveyance member 23, and a receiving member 25 are arranged in the developer storage chamber 18*a*. The developing roller 17 as a developer bearing member, a supply roller 20 as a developer supplying member, and a development blade 21 as a developer regulation member are arranged in the development chamber 18*b*. The developer storage chamber 18*a* and the development chamber 18*b* are separated by a partition 18*d* which is a part of the developing frame body 18. The partition 18*d* forms a part of the inner wall surface of the developer storage chamber 18*a* as well as a part of the inner wall surface of the development chamber 18*b*.

According to the present exemplary embodiment, when the process cartridge 7 is mounted on the apparatus main body 110, the development chamber 18*b* is arranged above the developer storage chamber 18*a*. The developer storage chamber 18*a* can communicate with the development chamber 18*b* via an opening 18*c* provided in the partition 18*d* that separates the chambers. In other words, according to the present exemplary embodiment, when the process cartridge 7 is mounted on the apparatus main body 110, the opening 18*c*, via which the developer storage chamber 18*a* can communicate with the development chamber 18*b*, is provided above the developer storage chamber 18*a*.

The developing roller 17 is supported by the developing frame body 18 in a rotatable manner via bearings (not illustrated) attached to the developing frame body 18. The bearings are provided to support both ends of the developing roller 17 in the rotation axial direction. The developing roller 17 is arranged to contact the periphery of the photosensitive drum 1. According to a driving force of the drive motor (not illustrated), as a driving unit, provided in the apparatus main body 110, the developing roller 17 rotates in the direction of an arrow D (counterclockwise). In other words, the photosensitive drum 1 and the developing roller 17 are driven so that they move in the forward direction at the contact portion.

Each of the supply roller 20 and the development blade 21 is arranged so as to contact the periphery of the developing roller 17. According to a driving force of the drive motor (not illustrated), as a driving unit, provided in the apparatus main body 110, the supply roller 20 rotates in the direction indicated by an arrow E (counterclockwise). In other words, the developing roller 17 and the supply roller 20 are driven so that the surface of each roller moves in the opposite direction at the contact portion. The supply roller 20 supplies toner to the developing roller 17 as well as removes the toner carried back to the development chamber 18*b* by the developing roller 17 from the developing roller 17. The toner removed by the supply roller 20 from the developing roller 17 is the toner not used for the development. The development blade 21 contacts the surface of the developing roller 17 at a portion downstream of the position where the developing roller 17 contacts the supply roller 20 in the rotation direction of the developing roller 17. The development blade 21 regulates the amount of toner to be supplied to the developing roller 17 by the supply roller 20, and causes friction between the development blade 21 and the developing roller 17 so that the toner is triboelectrically charged.

According to the present exemplary embodiment, the developing unit, which develops an electrostatic image on an electrophotographic photosensitive member, is configured by the developing roller 17, the supply roller 20, and the development blade 21.

The rotating shaft 22 is provided in the developer storage chamber 18*a* in a rotatable manner. The rotating shaft 22 is supported in a rotatable manner by the developing frame body 18 at both ends thereof in the axial direction. According to a driving force of the drive motor (not illustrated), as a driving unit, provided in the apparatus main body 110, the rotating shaft 22 rotates in the direction indicated by an arrow F (clockwise).

The conveyance member 23 is fixed to the rotating shaft 22. The conveyance member 23 agitates the toner in the developer storage chamber 18*a* and supplies it from the developer storage chamber 18*a* to the development chamber 18*b* via the opening 18*c* in the partition 18*d*. Further, the receiving member 25, which receives the toner dropping from the conveyance member 23 in the developer storage chamber 18*a*, is fixed to the rotating shaft 22. Configurations and functions of the rotating shaft 22, the conveyance member 23, and the receiving member 25 will be described in detail below. A conveyance unit 29 (agitation and conveyance unit), which includes the conveyance member 23 and the receiving member 25, conveys and agitates the developer stored in the developer storage chamber 18*a*.

Further, a light guiding member 42 as a detection unit (toner level detection unit) is provided in the developer storage chamber 18*a*. The light guiding member 42 is located at an inner wall surface (first side wall surface) Wa of the developer storage chamber 18*a* upstream of the opening 18*c* but downstream of an inner wall surface (bottom wall surface) Wb, in the rotation direction of the rotating shaft 22. The inner wall surface Wb forms the bottom of the developer storage chamber 18*a*. In other words, the light guiding member 42 is provided on the inner wall surface of the developer storage chamber 18*a* provided on the outer side in the rotation radial direction of the rotating shaft 22. Further, according to the present exemplary embodiment, the light guiding member 42 is located approximately at the center in the axial direction of the rotating shaft 22 (i.e., longitudinal direction of the developer storage chamber 18*a*). Furthermore, according to the present exemplary embodiment, the light guiding member 42 is a light transmission member used for the detection of the toner level using light transmission. The detection of toner level by light transmission performed by the light guiding member 42 will be described below.

The developing unit 4 is connected to the photosensitive member unit 13 in a rotatable manner about a shaft 26R (26L) which fits in a hole 19Ra (19La) formed in a bearing member 19R (19L). A spring 27 applies a force to the developing unit 4 so that the developing roller 17 rotates in the direction in which the developing roller 17 contacts the photosensitive drum 1 about the shaft 26R (26L). Accordingly, the developing roller 17 contacts the photosensitive drum 1 at least when the image forming operation is performed.

3. Conveyance of Toner

Next, the conveyance of toner by the conveyance member 23 will be described.

Figure 6:
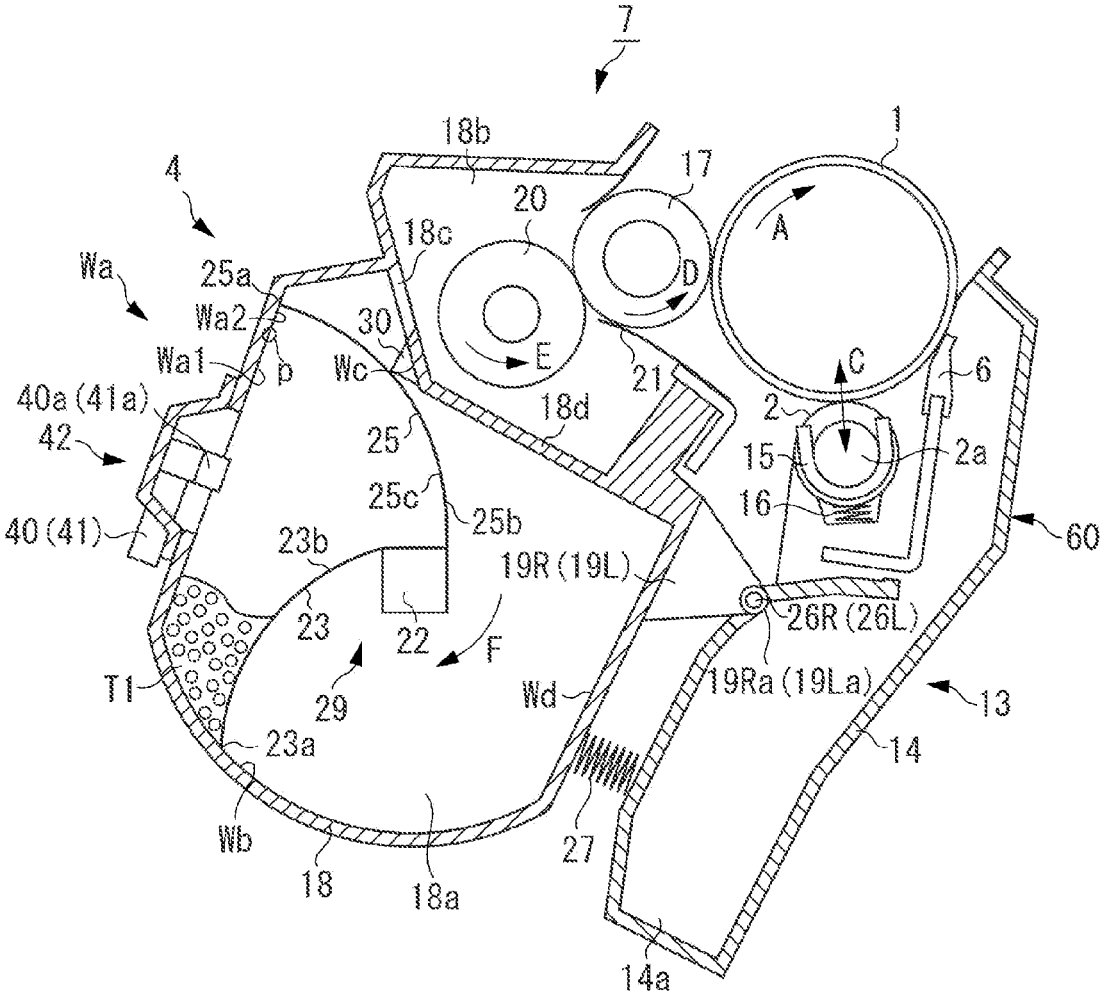
FIG. 6 is a longitudinal sectional view of the process cartridge illustrating a conveying process of the developer according to the first exemplary embodiment of the present invention.
Figure 7:
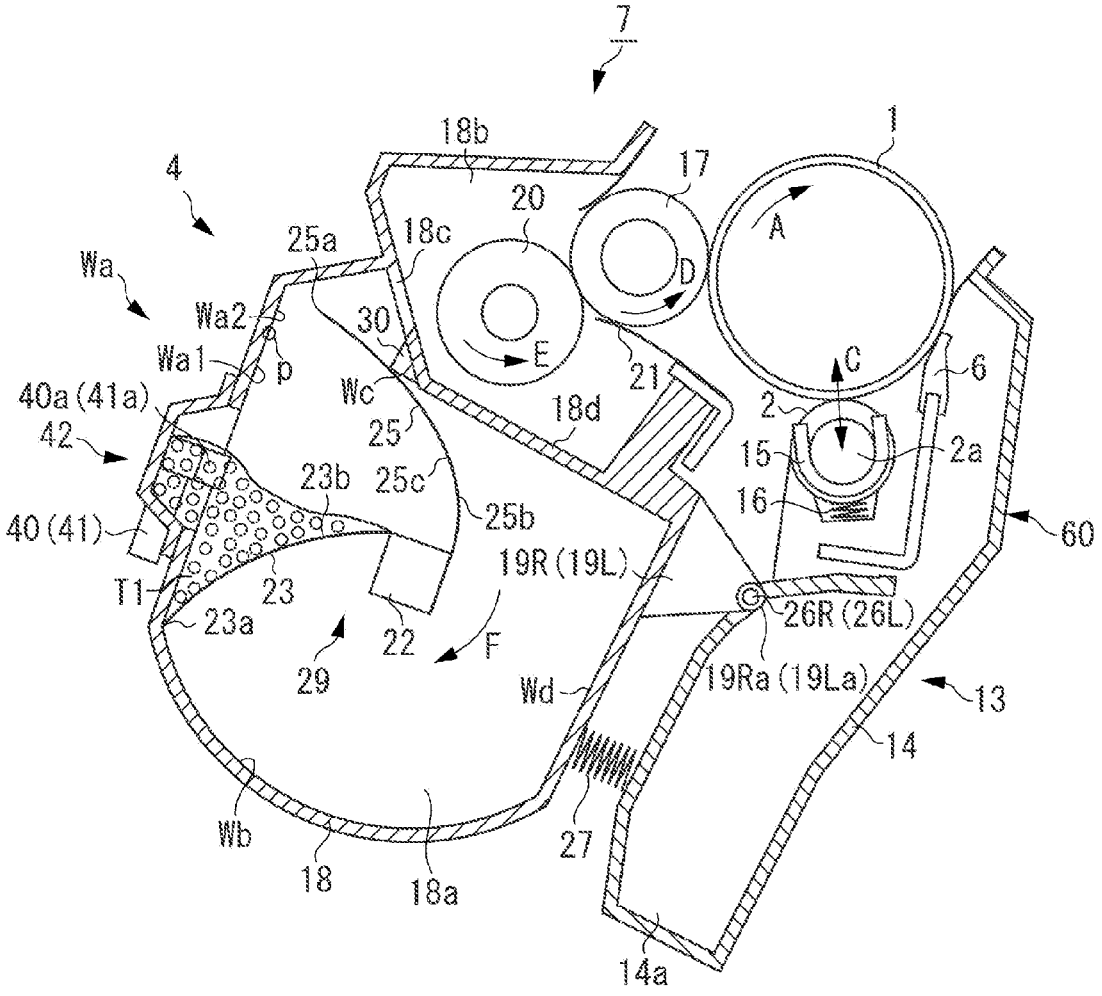
FIG. 7 is a longitudinal sectional view of the process cartridge illustrating a conveying process of the developer according to the first exemplary embodiment of the present invention.
Figure 8:
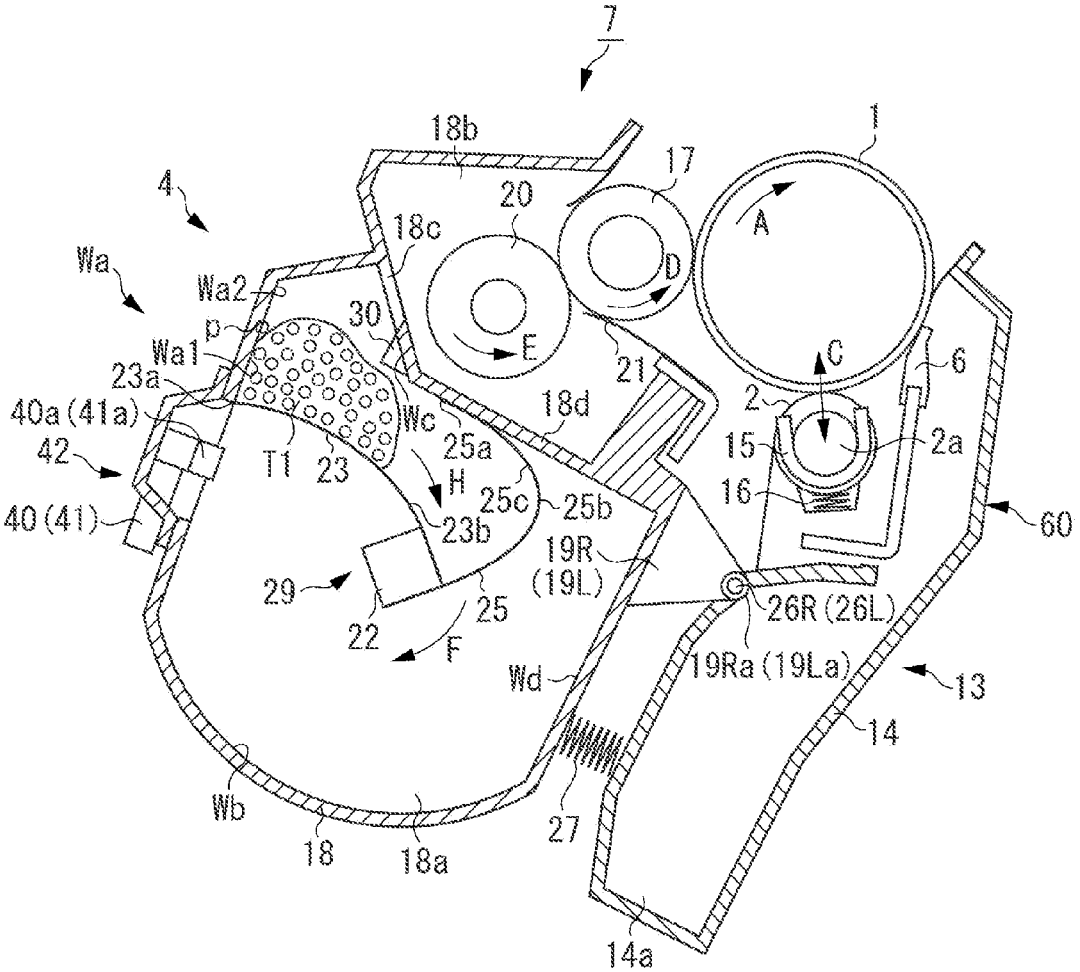
FIG. 8 is a longitudinal sectional view of the process cartridge illustrating a conveying process of the developer according to the first exemplary embodiment of the present invention.
Figure 9:
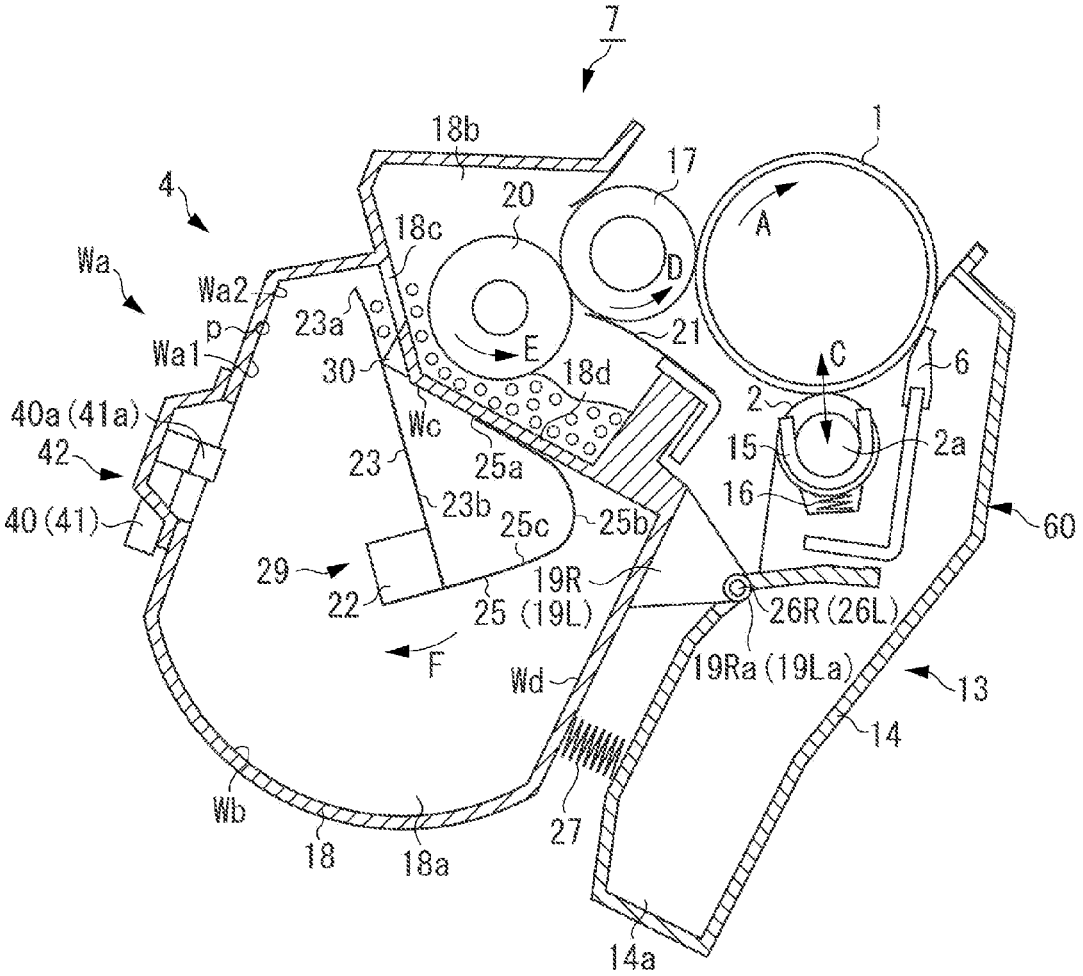
FIG. 9 is a longitudinal sectional view of the process cartridge illustrating a conveying process of the developer according to the first exemplary embodiment of the present invention.

As illustrated in FIG. 6, if the rotating shaft 22 rotates from a state where toner T1 is accumulated at the bottom of the developer storage chamber 18*a*, the toner is forced to travel by the conveyance member 23. When the rotating shaft 22 further rotates, as illustrated in FIGS. 7 and 8, the toner T1 is lifted by the conveyance member 23. Then, as illustrated in FIG. 9, some of the toner is sent out to the development chamber 18*b*. The toner not conveyed to the development chamber 18*b* drops from the conveyance member 23. Then, the toner is accumulated again at the bottom of the developer storage chamber 18*a*. By repeating this cycle, the toner in the developer storage chamber 18*a* is agitated and supplied to the development chamber 18*b*. The toner supplied to the development chamber 18*b* is used for the development of the electrostatic image formed on the photosensitive drum 1 by the developing unit as described above.

The developer storage chamber 18*a* has the bottom wall surface Wb and the first side wall surface Wa as the inner wall surfaces formed by the developing frame body 18. The first side wall surface Wa is located downstream of the bottom wall surface Wb and upstream of the opening 18*c* (i.e., the partition 18*d*), in the rotation direction of the rotating shaft 22. Further, the first side wall surface Wa includes a regulation wall surface Wa1 and an open wall surface Wa2. The regulation wall surface Wa1 contacts the conveyance member 23. The open wall surface Wa2 does not contact the conveying member 23 and is located downstream of the regulation wall surface Wa1 and upstream of the opening 18*c* (i.e., the partition 18*d*), in the rotation direction of the rotating shaft 22. The regulation wall surface Wa1 and the open wall surface Wa2 are connected at a boundary point p.

When the process cartridge 7 is mounted on the apparatus main body 110, the first side wall surface Wa is located above the bottom wall surface Wb, and the open wall surface Wa2 is located above the regulation wall surface Wa1. Further, when the process cartridge 7 is mounted on the apparatus main body 110, the boundary point p of the regulation wall surface Wa1 and the open wall surface Wa2 is above the light guiding member 42. Further, according to the present exemplary embodiment, when the process cartridge 7 is mounted on the apparatus main body 110, the opening 18*c* is located above the rotating shaft 22 and on the plane that passes through the center of rotation of the rotating shaft 22 and extends in the vertical direction, or on the side of the first side wall surface Wa of that plane. Further, according to the present exemplary embodiment, when the process cartridge 7 is mounted on the apparatus main body 110, the marginal portion of the opening 18*c* on the upper side is adjacent to a connection portion of the partition 18*d* and the first side wall surface Wa.

The conveyance member 23 contacts and slides over the bottom wall surface Wb and the regulation wall surface Wa1 according to the rotation of the rotating shaft 22. Since a force is applied to the conveyance member 23 against the elastic force of the conveyance member 23, the conveyance member 23 is deformed. When the conveyance member 23 slides over the bottom wall surface Wb and the regulation wall surface Wa1 while it contacts the surfaces according to the rotation of the rotating shaft 22, it bears and conveys toner on a bearing surface 23*b*. The bearing surface 23*b* is the surface of the conveyance member 23 on the downstream side in the rotation direction. Then, when an outer end 23*a*, which is the non-fixed end of the conveyance member 23, reaches the open wall surface Wa2 according to the rotation of the rotating shaft 22, the contact of the conveyance member 23 with the first side wall surface Wa of the developer storage chamber 18*a* is released. When the contact of the conveyance member 23 with the first side wall surface Wa of the developer storage chamber 18*a* is released, the conveyance member 23 restores its original shape according to its elastic restoring force. Thus, when the conveyance member 23 restores its original shape, the toner bore and conveyed on the bearing surface 23*b* of the conveyance member 23 is tossed up against gravity from the bearing surface 23*b* toward the opening 18*c* downstream of the open wall surface Wa2 in the rotation direction of the rotating shaft 22.

4. Detection of Toner Level by Light Transmission Method

Figure 3A:
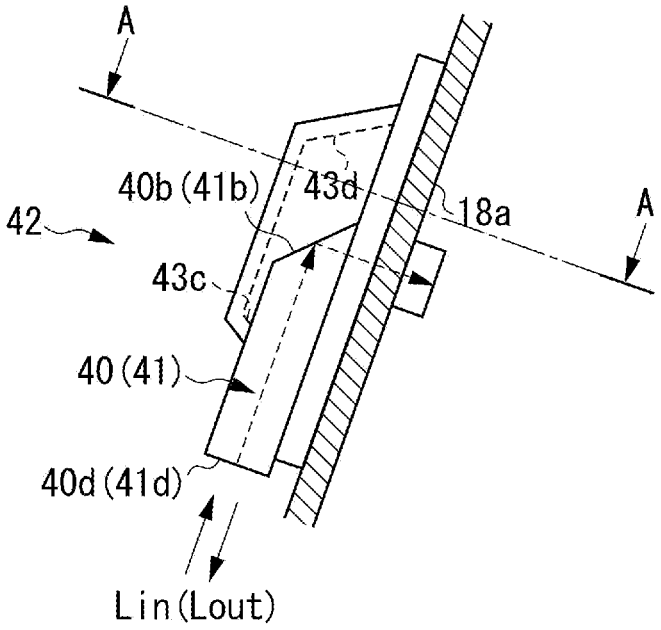
FIGS. 3A and 3B are a schematic longitudinal sectional view and a schematic transverse sectional view of a light guiding member according to the first exemplary embodiment of the present invention.
Figure 3B:
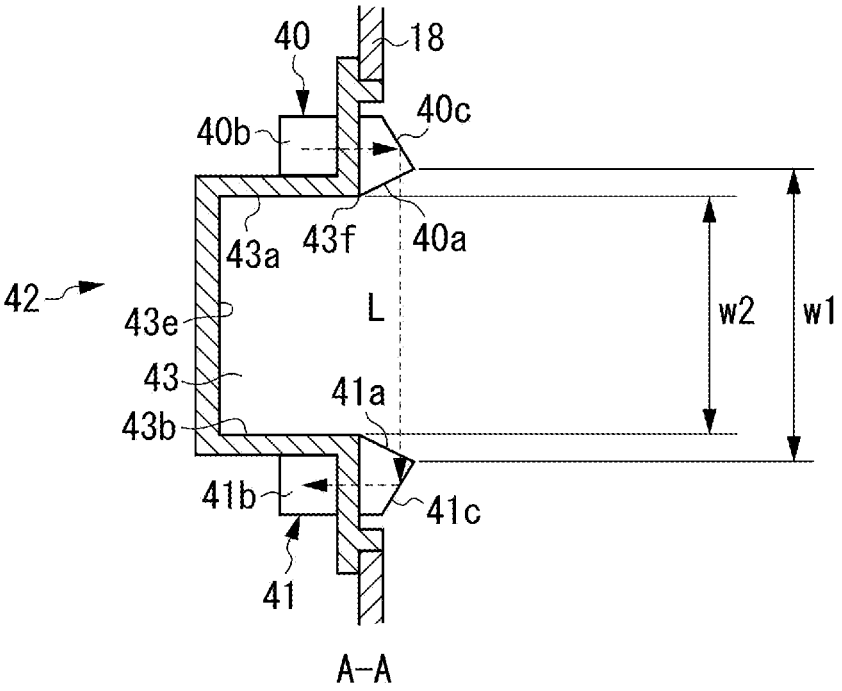

Next, the detection of toner level by light transmission using the light guiding member 42 will be described. FIG. 3A is a schematic longitudinal sectional view of the light guiding member 42 and the surrounding components. FIG. 3B is a schematic transverse sectional view of the light guiding member 42 and the surrounding components.

According to the present exemplary embodiment, the light guiding member 42 includes a light emission guiding unit 40, a light reception guiding unit 41, and a developer receiving unit 43 formed between the light emission guiding unit 40 and the light reception guiding unit 41. The developer receiving unit 43 is protruded toward the outside in the rotation radial direction of the rotating shaft 22. The developer receiving unit 43 is a box-like unit. The developer receiving unit 43 can communicate with the developer storage chamber 18*a* via a light member guide opening 43*f*. In other words, the developer receiving unit 43 has wall surfaces 43*a* and 43*b* facing each other in the axial direction of the rotating shaft 22, wall surfaces 43*c* and 43*d* facing each other on the upstream and the downstream in the rotation direction of the rotating shaft 22, and a wall surface 43*e* facing the light member guide opening 43*f*. According to the present exemplary embodiment, the light emission guiding unit 40, the light reception guiding unit 41, and the developer receiving unit 43 are formed into one unit as the light guiding member 42.

As illustrated in FIG. 3B, a light projecting window (light transmission window) 40*a* of the light emission guiding unit 40 and a light receiving window (light transmission window) 41*a* of the light reception guiding unit 41 used for the detection of remaining toner level by light transmission are arranged to face each other in the axial direction of the rotating shaft 22. As illustrated in FIG. 3A, detection light Lin emitted from a light emitting element (a light emitting device such as a light-emitting diode (LED)) (not illustrated), which is mounted on the apparatus main body 110, is guided into the light emission guiding unit 40. The detection light Lin is polarized by a reflection surface 40*b* of the light emission guiding unit 40 toward the inside of the developer storage chamber 18*a*. As illustrated in FIG. 3B, the polarized detection light Lin is deflected by a reflection surface 40*c* toward the light projecting window 40*a* and guided to the inside of the developer storage chamber 18*a*. Detection light L output from the light projecting window 40*a* passes through the inside of the developer storage chamber 18*a*. Then, the detection light L is guided to a light receiving window 41*a*. Further, the detection light L is deflected by reflection surfaces 41*c* and 41*b* of the light reception guiding unit 41, guided through the light reception guiding unit 41, and output from the process cartridge 7. Detection light Lout output from the process cartridge 7 is guided to a light receiving element (a light-receiving device such as a phototransistor) (not illustrated) mounted on the apparatus main body 110.

The developer receiving unit 43 of the light guiding member 42 is in communication with the developer storage chamber 18*a*. Accordingly, the toner conveyed by the conveyance member 23 flows into the developer receiving unit 43 of the light guiding member 42 from the developer storage chamber 18*a*. When the toner flows into the developer receiving unit 43, the space between the light projecting window 40*a* and the light receiving window 41*a* provided in the developer storage chamber 18*a* adjacent to the light guiding member opening 43*f* will be filled with toner.

Then, the detection light L is blocked in the developer storage chamber 18*a* by the toner conveyed by the conveyance member 23 for a certain period of time depending on the amount of toner in the developer storage chamber 18*a*. If the detection light L is blocked, the detection light L cannot reach the light receiving window 41*a*. Accordingly, the detection light L is not detected by the light-receiving unit mounted on the apparatus main body 110. On the other hand, if the conveyance member 23 passes the light guiding member 42 and the toner flows out from the developer receiving unit 43 of the light guiding member 42, the detection light L will not be blocked by the toner. In this case, the detection light L passes through the inside of the developer storage chamber 18*a*. Then, the detection light L is detected by the light-receiving unit mounted on the apparatus main body 110 via the light receiving window 41*a*.

In this manner, the amount of toner that remains in the developer storage chamber 18*a* can be detected according to measurement of the light-receiving time of the detection light L that has transmitted the inside of the developer storage chamber 18*a* and received by the light-receiving unit mounted on the apparatus main body 110, for each one turn of rotation of the conveyance member 23.

5. Rotating Shaft and Conveyance Unit

Figure 4A:
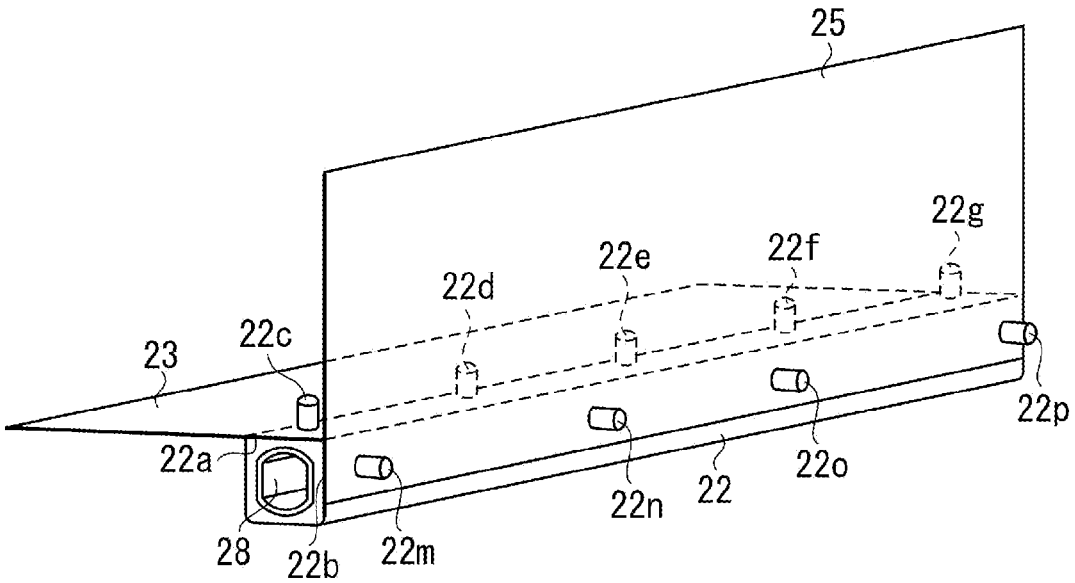
FIGS. 4A and 4B are a schematic perspective view and a schematic sectional view of a rotating shaft and components attached to the rotating shaft according to the first exemplary embodiment of the present invention.
Figure 4B:
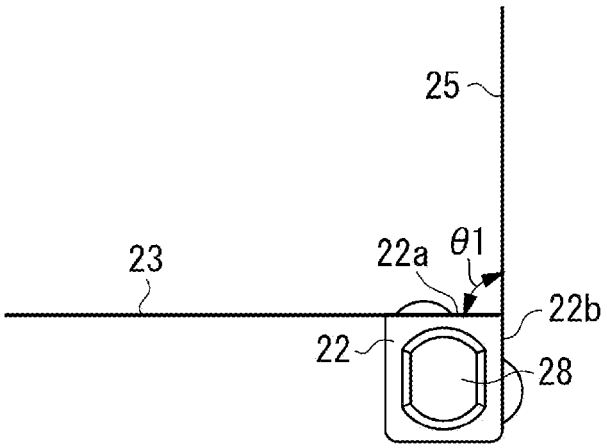

The rotating shaft 22 and the conveyance unit 29 according to the present exemplary embodiment will be described. FIG. 4A is a schematic perspective view of the rotating shaft 22 and the components of the conveyance unit 29. FIG. 4B is a schematic sectional view of the rotating shaft 22 and the components of the conveyance unit 29.

The conveyance member 23 is fixed to a conveyance member mounting surface 22*a* of the rotating shaft 22 for approximately the entire length of the rotating shaft 22 in the axial direction (longitudinal direction). The conveyance member mounting surface 22*a* is one side of the outside surfaces of the rotating shaft 22. The conveyance member 23 is a rectangular sheet member formed by a flexible resin sheet such as a polyester film, a polyphenylene sulfide film, or a polycarbonate film. The thickness of the conveyance member 23 is, for example, 50 to 250 μm. The inner side of the conveyance member 23 in the rotation radial direction of the rotating shaft 22 is fixed to the rotating shaft 22. According to the present exemplary embodiment, the conveyance member 23 is fixed to the rotating shaft 22 by bosses 22*c* to 22*g*, provided on the rotating shaft 22, using thermal caulking or ultrasonic welding. The fixing method and the component used for fixing the conveyance member 23 to the rotating shaft 22 are not limited to the method and component described above.

The length of the conveyance member 23 in the rotation radial direction of the rotating shaft 22 in the natural state is longer than the distance from the center of rotation of the rotating shaft 22 to the regulation wall surface Wa1 in the rotation radial direction of the rotating shaft 22. On the other hand, the length of the conveyance member 23 in the radial direction of the rotation of the rotating shaft 22 in the natural state is shorter than the distance from the center of rotation of the rotating shaft 22 to the open wall surface Wa2 in the rotation radial direction of the rotating shaft 22. Thus, according to the rotation of the rotating shaft 22, the outer end 23*a*, being the non-fixed end of the conveyance member 23 on the outer side in the rotation radial direction of the rotating shaft 22, slides over the regulation wall surface Wa1 in a contact state. At this time, the conveyance member 23 is deformed and warped toward the upstream side in the rotation direction of the rotating shaft 22 against the elastic force of the conveyance member 23. After the outer end 23*a* of the conveyance member 23 passes the boundary point p, the outer end 23*a* no longer touches the open wall surface Wa2. Thus, the conveyance member 23 recovers its natural state and moves to the opening 18*c* in the rotation direction of the rotating shaft 22 having the rotating shaft 22 as the supporting point. According to further rotation of the rotating shaft 22, the conveyance member 23 moves while the bearing surface 23*b* slides over a protruding portion 30 of the partition 18*d* described in detail below. If the rotating shaft 22 further rotates, the conveyance member 23 moves while the outer end 23*a* slides over an upper wall surface Wc, a second side wall surface Wd, and the bottom wall surface Wb. Then, the outer end 23*a* contacts the regulation wall surface Wa1 of the first side wall surface Wa again. The upper wall surface Wc is an inner wall surface of the partition 18*d*. The second side wall surface Wd is an inner wall surface facing the first side wall surface Wa.

The receiving member 25 is fixed to a receiving member mounting surface 22*b* of the rotating shaft 22 for approximately the entire length of the rotating shaft 22 in the axial direction. The receiving member mounting surface 22*b* is another side of the outside surfaces of the rotating shaft 22. According to the present exemplary embodiment, the receiving member mounting surface 22*b* is arranged at a position (θ1), which is 90 degrees in phase with the conveyance member mounting surface 22*a*, on the downstream side in the rotation direction of the rotating shaft 22. The receiving member 25 is a rectangular sheet member formed by a flexible resin sheet such as a polyester film or a polycarbonate film. The thickness of the conveyance member 23 is 100 μm or thinner. The toner conveyance capability of such a sheet member used for the receiving member 25 is lower than the toner conveyance capability of the sheet member used for the conveyance member 23. The inner side of the receiving member 25 in the rotation radial direction of the rotating shaft 22 is fixed to the rotating shaft 22. According to the present exemplary embodiment, the receiving member 25 is fixed to the rotating shaft 22 by bosses 22*m* to 22*p*, provided on the rotating shaft 22, using thermal caulking or ultrasonic welding. The fixing method and the component used for fixing the receiving member 25 to the rotating shaft 22 are not limited to the method and component described above.

The receiving member 25 contacts the bottom wall surface Wb and the regulation wall surface Wa1. When the receiving member 25 rotates and slides over the bottom wall surface Wb and the regulation wall surface Wa1 according to the rotation of the rotating shaft 22, the receiving member 25 is deformed and warped toward the upstream side in the rotation direction of the rotating shaft 22 against the elastic force of the receiving member 25. The length of the receiving member 25 in the rotation radial direction of the rotating shaft 22 in the natural state is longer than the length of the conveyance member 23 in the rotation radial direction of the rotating shaft 22. In other words, the length of the receiving member 25 in the radial direction of the rotation of the rotating shaft 22 in the natural state is set to a length longer than the distance from the center of rotation of the rotating shaft 22 to at least a portion of the open wall surface Wa2 in the rotation radial direction of the rotating shaft 22. Especially, according to the present exemplary embodiment, the length of the receiving member 25 is longer than the distance from the center of rotation of the rotating shaft 22 to the open wall surface Wa2 from the boundary point p to the connection portion of the partition 18*d* and the first side wall surface Wa (substantially the entire open wall surface Wa2). Thus, according to the rotation of the rotating shaft 22, the outside end 25*a* as the non-fixed end of the receiving member 25 on the outer side in the rotation radial direction of the rotating shaft 22, slides over the regulation wall surface Wa1 in a contact state and continuously slides over the open wall surface Wa2 in a contact state after it passes the boundary point p. According to further rotation of the rotating shaft 22, the receiving member 25 moves while the outside end 25*a* slides over the open wall surface Wa2 and a sliding surface 25*b*, which is a surface of the receiving member 25 on the downstream side in the rotation direction of the rotating shaft 22, slides over a protruding portion 30 of the partition 18*d* described in detail below. Then, according to further rotation of the rotating shaft 22, the outside end 25*a* of the receiving member 25 is separated from the open wall surface Wa2. Since the receiving member 25 returns to the natural state, the outside end 25*a* moves to the opening 18*c* in the rotation direction of the rotating shaft 22 having the protruding portion 30 as the supporting point. According to further rotation of the rotating shaft 22, the sliding surface 25*b* of the receiving member 25 slides over the protruding portion 30. If the rotating shaft 22 further rotates, the receiving member 25 moves while the outside end 25*a* slides over the upper wall surface Wc, the second side wall surface Wd, and the bottom wall surface Wb. Then, the outer end 25*a* again contacts the regulation wall surface Wa1 of the first side wall surface Wa.

Next, the functions of the conveyance member 23 and the receiving member 25 when the toner is conveyed will be described with reference to FIGS. 6 to 10.

As described above, according to the rotation of the rotating shaft 22, the conveyance member 23 carries the toner on the bearing surface 23*b* while the outer end 23*a*, which is the outer end of the conveyance member 23 in the rotation radial direction of the rotating shaft 22, contacts the first side wall surface Wa of the developer storage chamber 18*a* (see FIGS. 6 to 8). In this state, the conveyance member 23 is deformed according to the contact of the outer end 23*a* with the first side wall surface Wa. When the contact with the first side wall surface Wa of the developer storage chamber 18*a* is released, the toner bore by the bearing surface 23*b* is tossed into the opening 18*c* according to the elastic restoring force of the conveyance member 23 (see FIG. 9).

In this manner, the toner is conveyed to a level above a horizontal line that passes the center of rotation of the rotating shaft 22 by the conveyance member 23. When the toner is bore and conveyed on the bearing surface 23*b* of the conveyance member 23 to such a level, the toner slips off the bearing surface 23*b* of the conveyance member 23 due to gravity. If the toner is dumped from the conveyance member 23, the toner scattering may occur in the developer storage chamber 18*a*. Further, the toner inside the developer storage chamber 18*a* may also be scattered by an air current that occurs when the deformed conveyance member 23 is restored. If the scattered toner adheres to the light projecting window 40*a* or the light receiving window 41*a* of the light guiding member 42, the detection accuracy of the toner level may be reduced. Thus, according to the present exemplary embodiment, the receiving member 25 is provided on the rotating shaft 22.

FIG. 8 illustrates a state of the outer end 23*a* of the conveyance member 23 just before it reaches the boundary point p. If the rotation of the rotating shaft 22 proceeds and the conveyance member mounting surface 22*a* of the rotating shaft 22 further rotates from the horizontal state, the toner which is bore on the bearing surface 23*b* of the conveyance member 23 slips off the bearing surface 23*b* of the conveyance member 23 due to gravity. The toner that slips from the bearing surface 23*b* of the conveyance member 23 by the time the outer end 23*a* of the conveyance member 23 reaches the open wall surface Wa2 is received by a receiving surface 25*c* of the receiving member 25. The receiving surface 25*c* is the surface on the upstream side of the receiving member 25 in the rotation direction of the rotating shaft 22. The toner which is accumulated on the receiving surface 25*c* of the receiving member 25 slips off the receiving surface 25*c* of the receiving member 25 according to the rotation of the rotating shaft 22. However, the fall length from the receiving member 25 is shorter than the fall length from the conveyance member 23. Further, according to the present exemplary embodiment, the toner falls from the receiving surface 25*c* along the second side wall surface Wd in a state where the receiving member 25 is deformed according to the contact of the outside end 25*a* of the receiving member 25 with the second side wall surface Wd of the developer storage chamber 18*a*. Thus, heavy dumping of toner inside the developer storage chamber 18*a* can be prevented, and toner scattering due to the drop of the toner can be reduced. Accordingly, the amount of scattered toner which may adhere to the light projecting window 40*a* and the light receiving window 41*a* of the light guiding member 42 can be greatly reduced.

As illustrated in FIG. 8, the toner T1 lifted above the horizontal line that passes the center of rotation of the rotating shaft 22 by the conveyance member 23 falls from the surface of the conveyance member 23 in the direction of an arrow H according to gravity. When the toner T drops from the surface of the conveyance member 23, since the receiving member 25 arranged upstream of the light guiding member 42 receives the toner, the toner adhesion to the light projecting window 40*a* and the light receiving window 41*a* of the light guiding member 42 can be prevented. Accordingly, the detection of toner level by light transmission can be performed in a stable and accurate manner.

FIG. 9 illustrates the state of the conveyance member 23 immediately after the deformation of the conveyance member 23 has been released. When the deformation is released at once, an air current occurs in the developer storage chamber 18*a* in the rotation direction of the conveyance member 23. However, according to the present exemplary embodiment, since the receiving member 25 is provided downstream of the conveyance member 23 in the rotation direction of the rotating shaft 22, and since the outside end 25*a* of the receiving member 25 is deformed according to the contact with the upper wall surface Wc (inner wall surface) of the developer storage chamber 18*a* when the above-described air current is generated by the conveyance member 23, the air current generated by the conveyance member 23 will be reduced by the receiving member 25. Further, although toner scattering may occur between the conveyance member 23 and the receiving member 25, since the receiving member 25 is located upstream of the light projecting window 40*a* and the light receiving window 41*a* of the light guiding member 42 in the rotation direction of the rotating shaft 22, the scattered toner adhered to the light projecting window 40*a* and the light receiving window 41*a* of the light guiding member 42 can be prevented. Accordingly, the amount of scattered toner adhered to the light projecting window 40*a* and the light receiving window 41*a* of the light guiding member 42 can be greatly reduced.

Since the function required for the receiving member 25 is a receiving function of the toner that falls on the downstream side of the conveyance member 23 in the rotation direction, the fixing position of the receiving member 25 is not necessarily 90 degrees in phase with the conveyance member mounting surface 22*a* on the downstream side in the rotation direction of the rotating shaft 22. The receiving member 25 is desirably upstream of the light guiding member 42 when the toner falls from the conveyance member 23.

According to the present exemplary embodiment, when the contact of the outer end 23*a* of the conveyance member 23 with the first side wall surface Wa of the developer storage chamber 18*a* is released, the receiving member 25 contacts the upper wall surface Wc of the developer storage chamber 18*a* downstream of the opening 18*c* in the rotation direction of the rotating shaft 22. Simultaneously, the receiving member 25 receives the toner that falls from the bearing surface 23*b* of the conveyance member 23 by the receiving surface 25*c* on the upstream side in the rotation direction of the rotating shaft 22. Further, according to the present exemplary embodiment, after the conveyance member 23 passes the light guiding member 42, the receiving member 25 receives the toner that falls from the bearing surface 23*b* of the conveyance member 23 downstream of the conveyance member 23 and upstream of the light guiding member 42 in the rotation direction of the rotating shaft 22. Accordingly, regarding the developing unit that conveys the toner upward by using the elastic force of the conveyance member 23, the detection of toner level by light transmission can be performed in a stable and accurate manner.

According to the present exemplary embodiment, as illustrated in FIG. 4, the transmission of the driving force to the rotating shaft 22 is performed by a drive gear (not illustrated) which is inserted into a fitting hole 28 formed in the rotating shaft 22 through the side surface wall of the developer storage chamber 18*a*.

Figure 10:
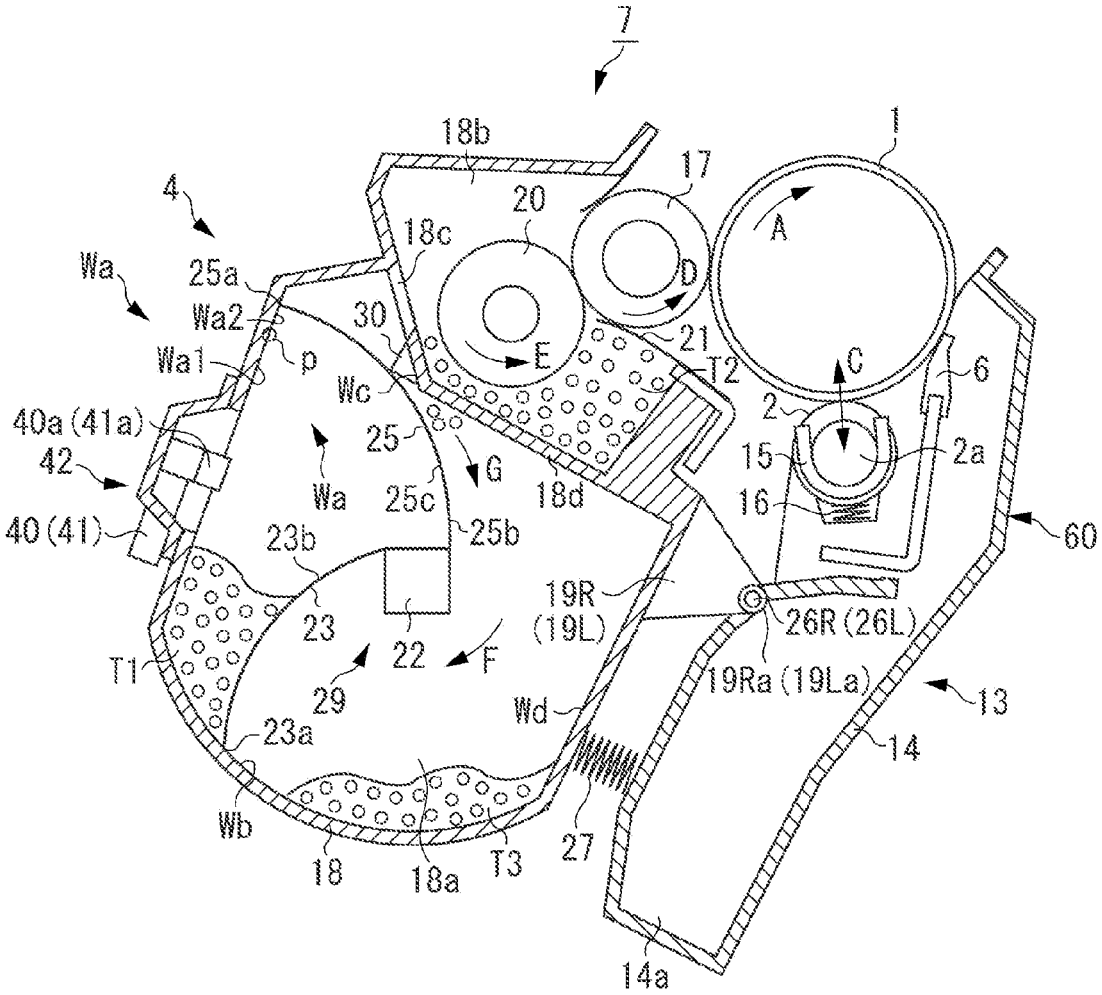
FIG. 10 is a longitudinal sectional view of the process cartridge illustrating circulation of the developer according to the first exemplary embodiment of the present invention.

6. Circulation of Toner Between Development Chamber and Developer Storage Chamber Next, the circulation of toner between the development chamber 18*b* and the developer storage chamber 18*a* will be described. FIG. 10 illustrates the process cartridge 7 in a state where the toner is accumulated in the development chamber 18*b* by the supply of toner from the developer storage chamber 18*a* to the development chamber 18*b* according to the rotation of the rotating shaft 22.

As described above, the toner T1 is supplied to the development chamber 18*b* by the conveyance member 23. The toner supplied to the development chamber 18*b* is further supplied to the developing roller 17 by the supply roller 20. The toner which is supplied to the developing roller 17 is controlled to approximately a predetermined amount (layer thickness) by the development blade 21. The toner not carried to the developing roller 17 according to the control performed by the development blade 21 remains in the development chamber 18*b*. The component of toner T2 that remains in the development chamber 18*b* may be affected by the friction which is generated at a portion where the supply roller 20 contacts the developing roller 17 and a portion where the developing roller 17 contacts the development blade 21. This adverse effect is called toner deterioration. The deterioration of the toner T2 that remains in the development chamber 18*b* is accelerated by repeated supply of toner to the developing roller 17 by the supply roller 20. If the toner deterioration is accelerated, the quality of the image formed by using the developing unit 4 may be reduced. Thus, accelerated deterioration of the toner T2 in the development chamber 18*b* needs to be avoided.

On the other hand, the toner T1 is supplied from the developer storage chamber 18*a* to the development chamber 18*b* with the rotation period of the rotating shaft 22. Thus, when the toner T2 which has been accumulated in the development chamber 18*b* for a predetermined amount overflows from the development chamber 18*b* to the developer storage chamber 18*a* via the opening 18*c*, the toner T2 is mixed with toner T3 in the developer storage chamber 18*a*. In this manner, continuous accumulation of the deteriorated toner in the development chamber 18*b* and accelerated toner deterioration can be prevented. Accordingly, the quality of the image formed by using the developing unit 4 can be maintained. This passing of toner from the development chamber 18*b* to the developer storage chamber 18*a*, and the mixing of the toner T2 with the toner T3 in the developer storage chamber 18*a* is called circulation of toner.

However, as described above, in order to reduce the toner scattering inside the developer storage chamber 18*a*, if the length of the receiving member 25 in the rotation radial direction of the rotating shaft 22 is increased so that the receiving member 25 slides over the inner wall surface of the developer storage chamber 18*a*, the circulation of toner may be blocked. In other words, each time the rotating shaft 22 rotates, the opening 18*c* may be temporarily blocked by the receiving member 25. This may prevent the toner from returning to the developer storage chamber 18*a* from the development chamber 18*b* via the opening 18*c*. Thus, the circulation of toner between the development chamber 18*b* and the developer storage chamber 18*a* may be temporarily blocked. If the circulation of toner is temporarily blocked, deterioration of the toner accumulated in the development chamber 18*b* may be accelerated. This may cause adverse effect on the image.

Thus, according to the present exemplary embodiment, the developing unit 4 has the protruding portion 30 that protrudes toward the inside of the developer storage chamber 18*a* from the partition 18*d* downstream of the opening 18*c* in the rotation direction of the rotating shaft 22. By the rotation of the rotating shaft 22, the receiving member 25 slides over both the first side wall surface Wa of the developer storage chamber 18*a* upstream of the opening 18*c* in the rotation direction of the rotating shaft 22 and the protruding portion 30 while the receiving member 25 is in contact with them within one turn of rotation of the rotating shaft 22. According to the present exemplary embodiment, as described above, when the outside end 25*a* of the receiving member 25 contacts the open wall surface Wa2, the sliding surface 25*b* also contacts the protruding portion 30. Especially, according to the present exemplary embodiment, the outside end 25*a* of the receiving member 25 contacts the first side wall surface Wa of the developer storage chamber 18*a* at a position downstream of the boundary point p, in the rotation direction of the rotating shaft 22, where the contact of the outer end 23*a* of the conveyance member 23 with the first side wall surface Wa of the developer storage chamber 18*a* is released. Simultaneously, the sliding surface 25*b*, which is the surface on the downstream side of the receiving member 25 in the rotation direction of the rotating shaft 22, contacts the protruding portion 30.

Figure 5:
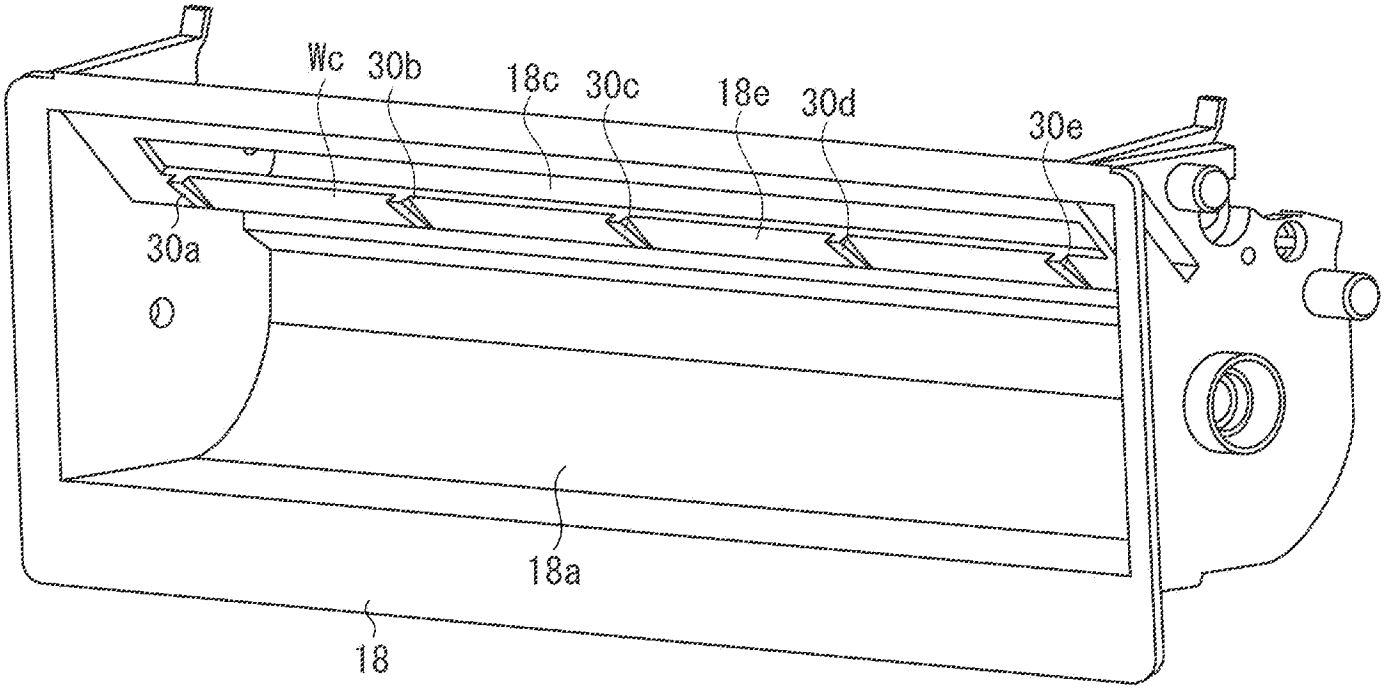
FIG. 5 is a schematic perspective view of a developing frame body according to the first exemplary embodiment of the present invention.

The circulation of toner will be further described with reference to FIG. 5. FIG. 5 is a schematic perspective view of the developing frame body 18 showing the opening 18*c* of the developer storage chamber 18*a*. According to the present exemplary embodiment, the developing unit 4 includes five protruding portions 30 (protruding portions 30*a*, 30*b*, 30*c*, 30*d*, and 30*e*) provided on the upper wall surface Wc, which is the inner wall surface of the partition 18*d* downstream of the opening 18*c*, in the axial direction of the rotating shaft 22. In other words, according to the present exemplary embodiment, the protruding portions 30*a*, 30*b*, 30*c*, 30*d*, and 30*e* are formed on the upper wall surface Wc approximately equally-spaced in the axial direction of the rotating shaft 22 (in the longitudinal direction of the opening 18*c*).

According to the present exemplary embodiment, the partition 18*d* includes a first portion 18*d*1 and a second portion 18*d*2 which are connected to each other. The first portion 18*d*1 extends along a plane where the opening 18*c* is formed. The second portion 18*d*2 extends along a plane that intersects the plane formed by the opening 18*c*. Further, the second portion 18*d*2 is located downstream of the first portion 18*d*1 in the rotation direction of the rotating shaft 22. The partition 18*d* is protruded (bent over) toward the developer storage chamber 18*a* by the first portion 18*d*1 and the second portion 18*d*2. According to the present exemplary embodiment, the protruding portion 30 is formed on the first portion 18*d*1. Further, one end of the protruding portion 30 is provided near a connection portion 18*d*3 which connects the first portion 18*d*1 and the second portion 18*d*2. According to the present exemplary embodiment, the protruding portion 30 is adjacent to the opening 18*c* and protrudes toward the inside of the developer storage chamber 18*a* from the plane where the opening 18*c* is formed.

According to the present exemplary embodiment, the receiving member 25 moves while sliding over the open wall surface Wa2 and the protruding portion 30 at the same time. In this manner, when the receiving member 25 passes the vicinity of the opening 18*c* after the supply of toner to the development chamber 18*b* by the conveyance member 23 to the next supply of toner, a wide space that allows the circulation of toner via the opening 18*c* is formed. Since the receiving member 25 contacts the open wall surface Wa2 and is warped toward the upstream side in the rotation direction of the rotating shaft 22, the state where a space is formed between the receiving member 25 and the opening 18*c* is maintained as long as possible. Further, when the space is formed, since the sliding surface 25*b* of the receiving member 25 contacts the plurality of the protruding portions 30, a space 18*e* (see FIG. 5) is formed between the sliding surface 25*b* of the receiving member 25 and the partition 18*d* in the space between neighboring protruding portions 30. Thus, even if the receiving member 25 is in the vicinity of the opening 18*c*, after the toner passes the opening 18*c*, it can travel through the space between the opening 18*c* and the receiving member 25, and through the space 18*e* of the protruding portions 30 along the sliding surface 25*b* of the receiving member 25.

If the protruding portion 30 is not provided, even if a space is formed between the opening 18*c* and the receiving member 25 by the contact of the receiving member 25 with the open wall surface Wa2 and the partition 18*d* downstream of the opening 18*c* at the same time, the space is closed according to the contact of the receiving member 25 with the partition 18*d*. Thus, the toner that has passed the opening 18*c* cannot travel on the downstream side in the rotation direction of the receiving member 25 along the receiving member 25, and the travel of toner via the opening 18*c* will be blocked.

Further, according to the present exemplary embodiment, the protruding portion 30 protrudes toward the developer storage chamber 18*a* from the plane formed by the opening 18*c*. Thus, even when the contact of the outside end 25*a* of the receiving member 25 with the open wall surface Wa2 is released, the outside end 25*a* of the receiving member 25 will be separated from the opening 18*c* having the protruding portion 30 as the supporting point. Thus, the opening 18*c* will not be blocked by the receiving member 25.

According to the present exemplary embodiment, the travel of toner via the opening 18*c* will not be blocked by the receiving member 25 each time the rotating shaft 22 rotates. Further, a flow path of toner, along which the toner that has returned from the development chamber 18*b* to the developer storage chamber 18*a* can travel, can be formed. According to this flow path, as illustrated by an arrow G in FIG. 10, the toner can be guided to the downstream side in the rotation direction of the receiving member 25. Since the flow path is formed, the blocking of the circulation of toner between the development chamber 18*b* and the developer storage chamber 18*a* each time the rotating shaft 22 rotates, can be prevented, and a fine image can be formed in a stable manner.

Although it is desirable to form a plurality of the protruding portions 30 on the upper wall surface Wc as it is helpful in easily forming the flow path of toner as described above, for example, one protruding portion 30 may be formed on at approximately the middle of the upper wall surface Wc in the axial direction of the rotating shaft 22. In this case, the flow path of the toner is formed on both sides of the protruding portion 30.

According to the present exemplary embodiment, the blocking of the circulation of toner via the opening 18*c* in the partition 18*d* which separates the developer storage chamber 18*a* and the development chamber 18*b* can be prevented.

Next, a second exemplary embodiment of the present invention will be described. Basic configurations and operations of the developing unit, the process cartridge, and the electrophotographic image forming apparatus according to the present exemplary embodiment are similar to those of the first exemplary embodiment. Thus, components having a function and configuration similar to or corresponding to those in the first exemplary embodiment are denoted by the same reference numerals and their descriptions are omitted for simplification.

Figure 11:
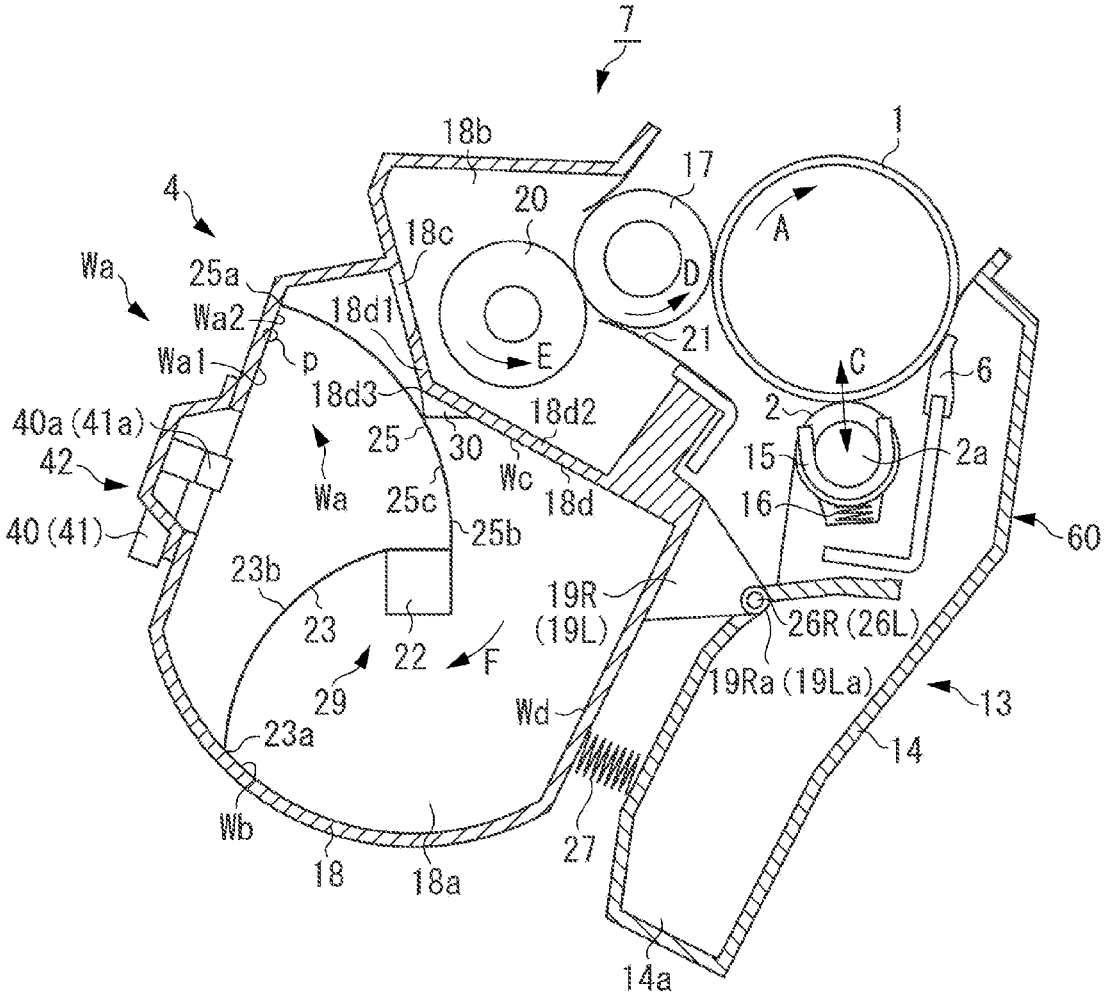
FIG. 11 is a longitudinal sectional view of a process cartridge according to a second exemplary embodiment of the present invention.
Figure 12:
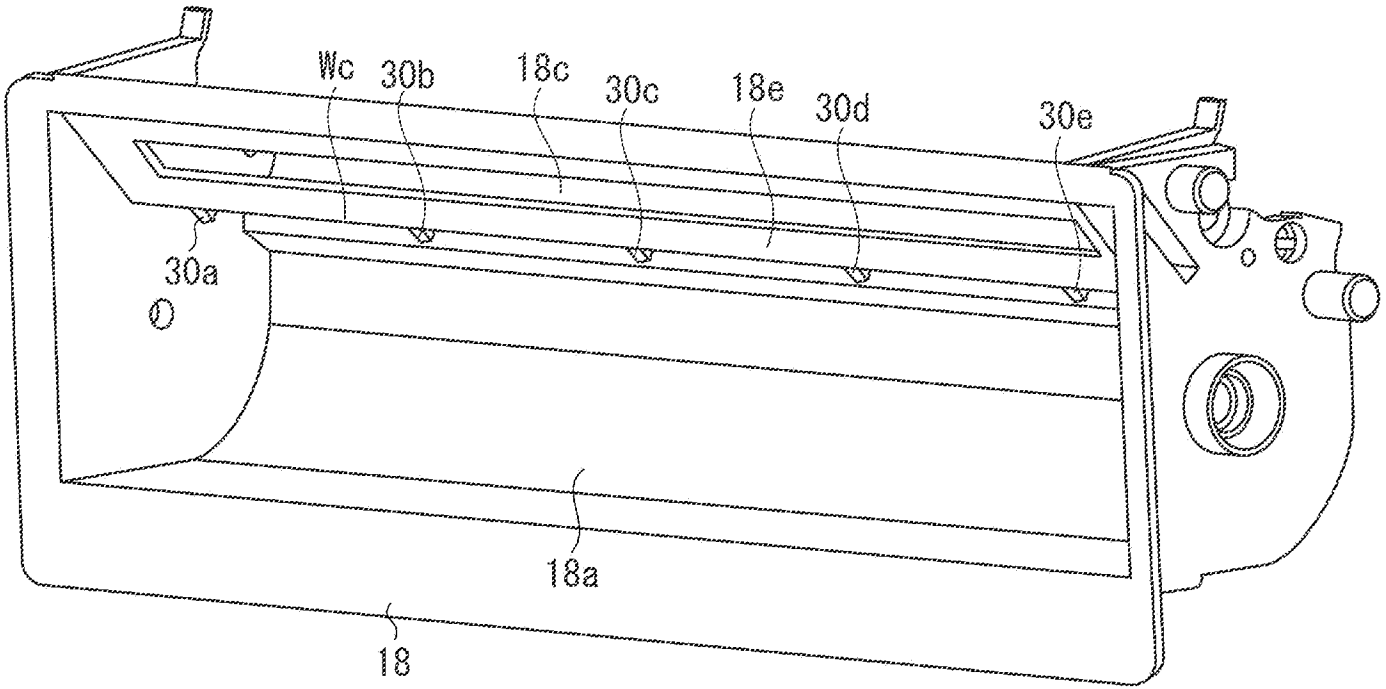
FIG. 12 is a schematic perspective view of a developing frame body according to the second exemplary embodiment of the present invention.

FIG. 11 is a longitudinal sectional view of the process cartridge 7 according to the present exemplary embodiment. Further, FIG. 12 is a schematic perspective view of the developing frame body 18 showing the opening 18*c* of the developer storage chamber 18*a* according to the present exemplary embodiment.

The present exemplary embodiment differs from the first exemplary embodiment in that the protruding portion 30 is formed on the second portion 18*d*2 adjacent to the connection portion 18*d*3 which connects the first portion 18*d*1 and the second portion 18*d*2 of the partition 18*d*. According to the present exemplary embodiment, the first portion 18*d*1 of the partition 18*d* partially extends along the plane formed by the opening 18*c*. As is with the first exemplary embodiment, the protruding portions 30*a* to 30*e* may be formed on the upper wall surface Wc approximately equally-spaced in the axial direction of the rotating shaft 22 (i.e., in the longitudinal direction of the opening 18*c*).

Further, as is with the first exemplary embodiment, the receiving member 25 moves while it simultaneously contacts the open wall surface Wa2 and the protruding portion 30 each time the rotating shaft 22 rotates. Thus, a state where a space is provided between the opening 18*c* and the receiving member 25 is maintained as long as possible. Further, the space 18*e* is formed between the sliding surface 25*b* of the receiving member 25 and the partition 18*d* between the plurality of protruding portions 30. Accordingly, the flow path of toner along which the toner that has returned from the development chamber 18*b* to the developer storage chamber 18*a* can travel, can be formed. According to this flow path, the toner can be guided to the downstream side in the rotation direction of the receiving member 25.

According to the present exemplary embodiment, the protruding portion 30 is not protruded from the plane with the opening 18*c* being formed toward the developer storage chamber 18*a*. However, until when the contact of the outside end 25*a* of the receiving member 25 with the open wall surface Wa2 is released, a wide space that allows the travel of the toner between the receiving member 25 and the opening 18*c* is formed, and the toner can travel via the space 18*e* between the plurality of the protruding portions 30. Thus, according to the configuration of the present exemplary embodiment, depending on the likelihood of toner deterioration, the blocking of toner that travels via the opening 18*c* by the receiving member 25 each time the rotating shaft 22 rotates can be prevented to a satisfactory level.

Thus, according to the present exemplary embodiment, the receiving member 25 blocking the travel of toner via the opening 18*c* each time the rotating shaft 22 rotates can be prevented. Accordingly, the blocking of the circulation of toner between the development chamber 18*b* and the developer storage chamber 18*a* can be prevented, and a good image can be stably formed.

Next, a third exemplary embodiment of the present invention will be described. Basic configurations and operations of the developing device, the process cartridge, and the electrophotographic image forming apparatus according to the present exemplary embodiment are similar to those of the first exemplary embodiment. Therefore, components having a function and configuration similar to or corresponding to those in the first exemplary embodiment are denoted by the same reference numerals and their descriptions are omitted for simplification.

Figure 13A:
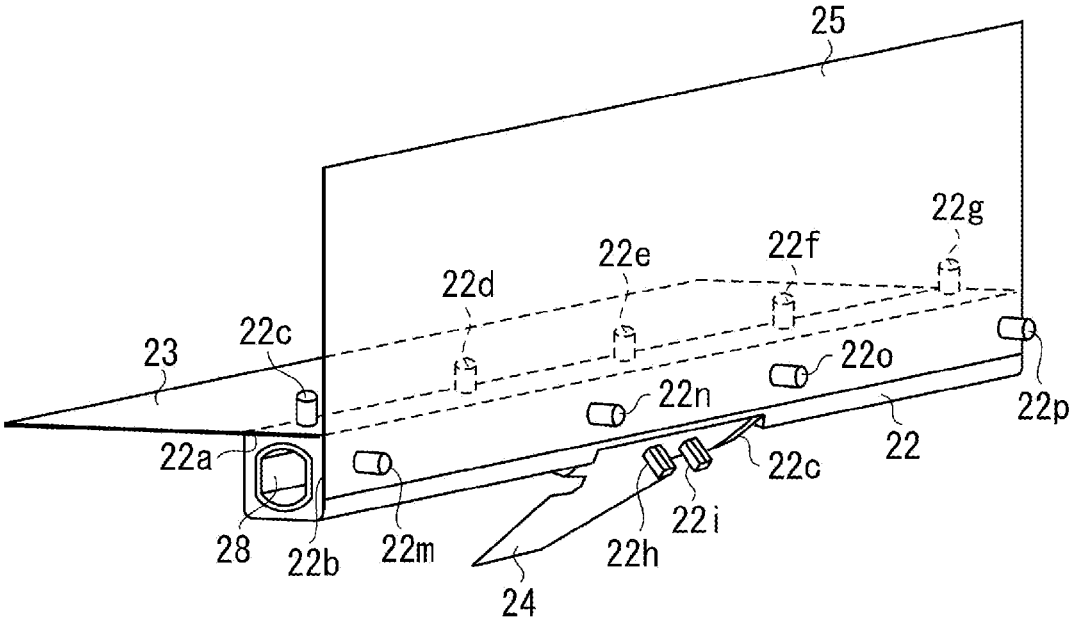
FIGS. 13A and 13B are a schematic perspective view and a schematic cross-sectional view of the rotating shaft and the components attached to the rotating shaft according to a third exemplary embodiment of the present invention.
Figure 13B:
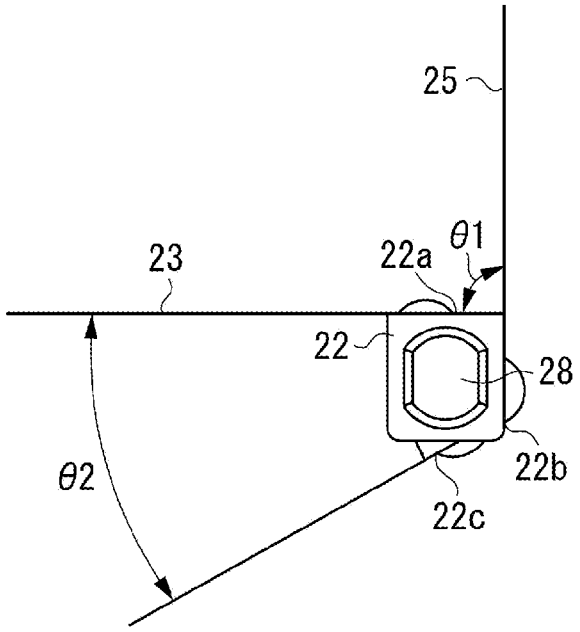

FIG. 13A is a schematic perspective view of the rotating shaft 22 and the components of the conveyance unit 29. FIG. 13B is a schematic sectional view of the rotating shaft 22 and the components of the conveyance unit 29.

According to the present exemplary embodiment, a cleaning member mounting surface 22*c* is fixed to the rotating shaft 22 near the center of the rotating shaft 22 in the axial direction. The cleaning member mounting surface 22*c* is fixed to a position (θ2) 30 degrees in phase with the conveyance member mounting surface 22*a* toward the upstream direction in the rotation direction of the rotating shaft 22. A cleaning member 24 is fixed to the cleaning member mounting surface 22*c*. The inner side of the cleaning member 24 in the rotation radial direction of the rotating shaft 22 is fixed to the rotating shaft 22. According to the present exemplary embodiment, the cleaning member 24 is fixed to the rotating shaft 22 by bosses 22*h* and 22*i*, provided on the rotating shaft 22, subjecting to thermal caulking or ultrasonic welding. The fixing method and the component used for fixing the cleaning member 24 to the rotating shaft 22 are not limited to the method and component described above.

Figure 14:
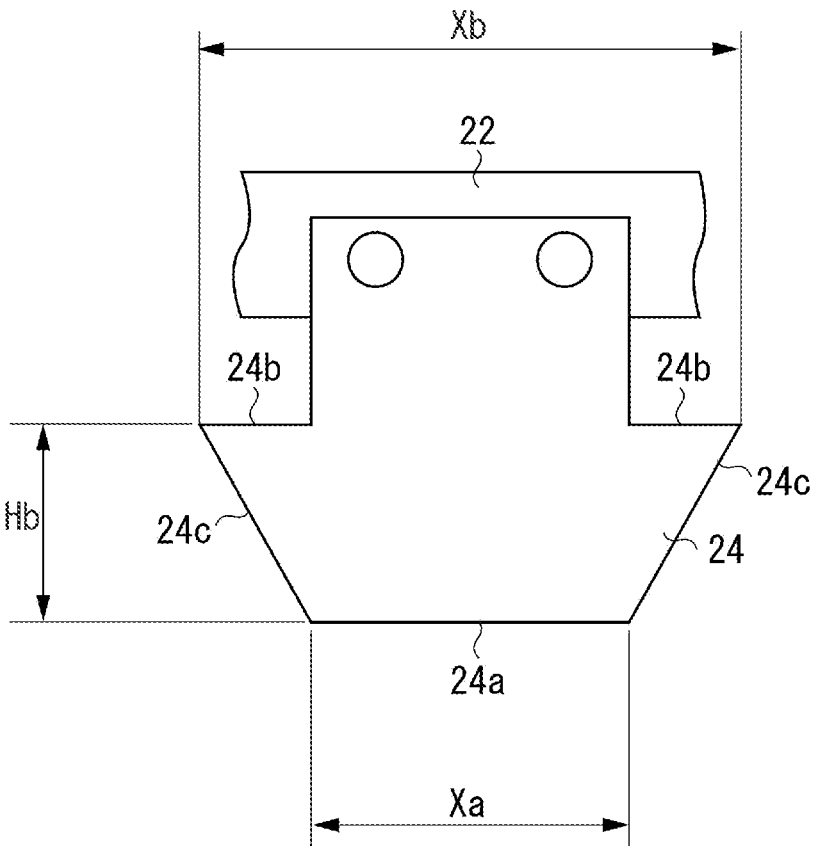
FIG. 14 is a plan view of a cleaning member according to the third exemplary embodiment of the present invention.

FIG. 14 is a schematic diagram of the cleaning member 24. As illustrated in FIG. 14, the non-fixed end of the cleaning member 24 is approximately trapezoid. That is, a width Xa of an end 24*a* which is the non-fixed end of the cleaning member 24 on the outer side in the rotation radial direction of the rotating shaft 22 is shorter than a width Xb corresponding to a side end 24*b* which is a distance Hb inward in the rotation radial direction from the end 24*a* (Xa<Xb). Each of inclined side portions 24*c* of the cleaning member 24 extends from the end 24*a* to the side 24*b*. One of the inclined side portions 24*c* contacts the light projecting window 40*a* and the other contacts the light receiving window 41*a* to remove the toner adhered to the light projecting window 40*a* and the light receiving window 41*a*, which are arranged to face each other. The cleaning member 24 can be formed by using a flexible resin sheet such as a polyester film or a polyphenylene sulfide film. The thickness of the sheet member is 50 to 250 μm so that the cleaning member 24 can easily enter the space between the light projecting window 40*a* and the light receiving window 41*a*. According to the present exemplary embodiment, as illustrated in FIG. 3B, the light projecting window 40*a* and the light receiving window 41*a* which are arranged to face each other are formed in such a manner that a distance w1 between the windows on the side closer to the developer storage chamber 18*a* is longer than the a distance w2 between the windows on the side farther away from the developer storage chamber 18*a* (i.e., w1>w2). Since the non-fixed portions of the cleaning member 24 contact the inclined surfaces of the light projecting window 40*a* and the light receiving window 41*a* which are arranged to face each other, the cleaning member 24 is approximately trapezoid as described above.

Figure 15A:
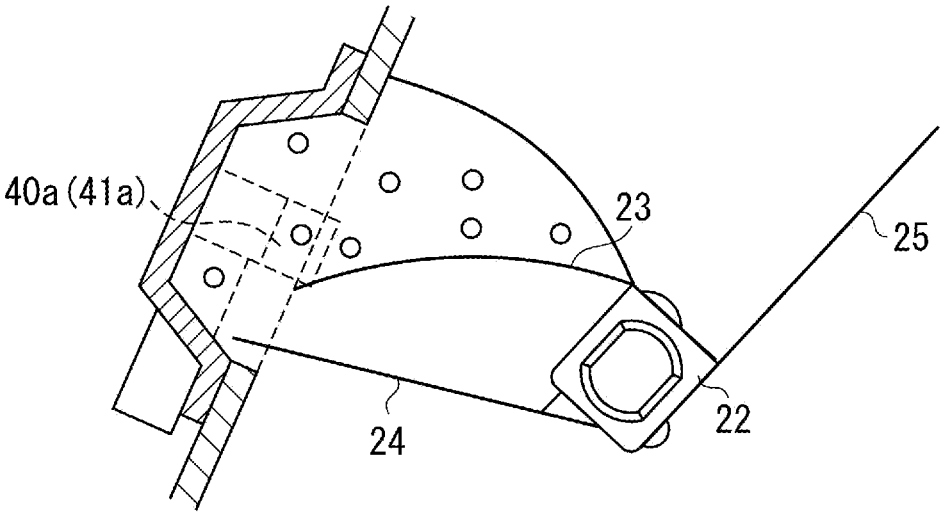
FIGS. 15A and 15B are schematic sectional views of a detection unit illustrating a function of the cleaning member according to the third exemplary embodiment of the present invention.
Figure 15B:
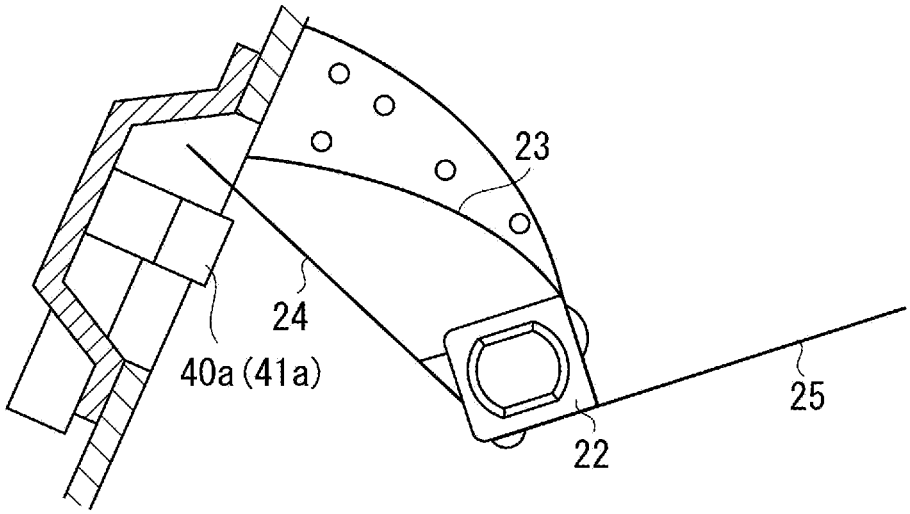

FIG. 15A illustrates a state just before the light projecting window 40*a* and the light receiving window 41*a* are cleaned by the cleaning member 24. In this state, the detection light L is blocked by the toner conveyed by the conveyance member 23 inside the developer storage chamber 18*a* and cannot reach the light receiving window 41*a*. Accordingly, the detection light L is not detected by the light-receiving unit mounted on the apparatus main body 110. On the other hand, FIG. 15B illustrates a state immediately after the light projecting window 40*a* and the light receiving window 41*a* have been cleaned by the cleaning member 24. In this state, the detection light L is transmitted through the inside of the developer storage chamber 18*a* and detected by the light-receiving unit mounted on the apparatus main body 110 via the light receiving window 41*a*.

According to the configuration illustrated in FIG. 15B, the amount of toner that remains in the developer storage chamber 18*a* can be detected according to measurement of the light-receiving time of the detection light L that transmitted through the inside of the developer storage chamber 18*a* and received by the light-receiving unit mounted on the apparatus main body 110, for each one turn of rotation of the conveyance member 23.

However, according to the configuration described above, if the toner scattered in the developer storage chamber 18*a* is attached to the light projecting window 40*a* or the light receiving window 41*a* after it has been cleaned by the cleaning member 24, it may cause variation in the detection accuracy of the toner level.

On the other hand, according to the present exemplary embodiment, the receiving member 25 is provided on the rotating shaft 22 as is with the first exemplary embodiment. Thus, the toner that falls from the conveyance member 23 is received by the receiving member 25 provided downstream of the conveyance member 23 and upstream of the light guiding member 42 in the rotation direction of the rotating shaft 22. Further, the air current that moves in the rotation direction of the conveyance member 23, which is generated by the restoration of the shape of the conveyance member 23 from the deformed state, can be suppressed by the receiving member 25. Furthermore, even if the toner scattering occurs between the conveyance member 23 and the receiving member 25, since the receiving member 25 is positioned upstream of the light guiding member 42, the travel of the scattered toner to the light projecting window 40*a* and the light receiving window 41*a* of the light guiding member 42 can be prevented. Thus, the occurrence of the toner scattering inside the developer storage chamber 18*a* can be reduced, and the amount of adhesion of the scattered toner to the light projecting window 40*a* and the light receiving window 41*a* of the light guiding member 42 can be greatly reduced.

The receiving member 25 is desirably positioned upstream of the light guiding member 42 when the toner falls from the conveyance member 23, especially when the cleaning member 24 passes the light guiding member 42.

According to the present exemplary embodiment, as is with the first exemplary embodiment, since the protruding portion 30 is formed on the partition 18*d*, the receiving member 25 blocking the circulation of toner via the opening 18*c* each time the rotating shaft 22 rotates can be prevented.

According to the present exemplary embodiment, the developing unit 4 includes the cleaning member 24 provided upstream of the conveyance member 23 in the rotation direction of the rotating shaft 22. The cleaning member 24 is fixed to the rotating shaft 22 and cleans the light guiding member 42 according to the rotation of the rotating shaft 22. Further, according to the present exemplary embodiment, when the cleaning member 24 passes by the light guiding member 42, the receiving member 25 receives the toner that falls from the bearing surface 23*b* of the conveyance member 23 at a position downstream of the conveyance member 23 but upstream of the light guiding member 42 in the rotation direction of the rotating shaft 22.

According to the present exemplary embodiment, regarding the configuration including the cleaning member 24 which is useful in improving the detection accuracy of the toner level, the blocking of the circulation of toner via the opening 18*c* by the receiving member 25, which is provided to prevent the toner from adhering to the light guiding member 42 after cleaning, can be prevented.

According to the present exemplary embodiment, although the protruding portion 30, such as the one described in the first exemplary embodiment, is provided in the developing unit 4, the protruding portion 30 such as the one described in the second exemplary embodiment may be provided in the developing unit 4.

Although the present invention has been described with reference to the exemplary embodiments, the present invention is not limited to the above-described exemplary embodiments.

For example, the present invention is not limited to the image forming apparatus using the intermediate transfer method, and can also be applied to an image forming apparatus using the direct transfer method. In place of the intermediate transfer member of the image forming apparatus using the intermediate transfer method, the image forming apparatus using the direct transfer method includes a recording material carrier, such as an endless belt, which bears and conveys the recording material. The toner image formed on a photosensitive member is directly transferred to the recording material bore and conveyed on the recording material carrier.

The electrophotographic image forming apparatus is not limited to an in-line apparatus. For example, there is an image forming apparatus that includes a plurality of developing devices for one photosensitive member. The electrostatic images sequentially formed on the photosensitive member are developed by each of the plurality of developing devices, and the toner images are sequentially transferred to a recording material on an intermediate transfer member or a recording material bearing member. The present invention can also be applied to such an image forming apparatus.

Further, the electrophotographic image forming apparatus is not limited to a color image forming apparatus and can also be applied to a single color (monocolor) image forming apparatus.

According to the above-described exemplary embodiments, although an electrophotographic image forming apparatus using a removable process cartridge has been used in the description, the present invention can also be applied when the developing device is separately provided in a form of a cartridge and mounted on the apparatus main body in a removable manner from the electrophotographic image forming apparatus. Further, the present invention can also be applied even if the developing device is substantially fixed to the electrophotographic image forming apparatus and not easily removed.

According to the present invention, the blocking of the circulation of the developer via an opening in a partition that separates the developer storage chamber and the development chamber can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A developing device comprising:

a developer bearing member configured to bear developer;

a development chamber including the developer bearing member;

a developer storage chamber arranged below the development chamber in a developing operation and configured to store developer to be supplied to the development chamber;

a partition configured to separate the development chamber and the developer storage chamber and having an opening that allows communication between the developer storage chamber and the development chamber;

a rotating shaft configured to be rotatable and provided inside the developer storage chamber;

a sheet member attached to the rotating shaft; and a plurality of protruding portions configured to protrude toward the inside of the developer storage chamber from the partition and located on a downstream side of the opening in a rotation direction of the rotating shaft, wherein the sheet member has a length such that a free end of the sheet member is contactable to an inner wall surface of the developer storage chamber in a state that the sheet member contacts both the plurality of protruding portions and the inner wall surface of the developer storage chamber when the sheet member rotates with the rotating shaft.

2. The developing device according to claim 1, wherein, the sheet member contacts the plurality of protruding portions so that a space is formed between the sheet member and the partition which forms the opening.

3. The developing device according to claim 1, wherein the plurality of protruding portions is provided with a space in the axial direction of the rotating shaft.

4. The developing device according to claim 1, further comprising another sheet member attached to the rotating shaft.

5. The developing device according to claim 4, wherein in a rotation radial direction of the rotating shaft, a length of the sheet member is shorter than a length of the another sheet member.

6. The developing device according to claim 1, wherein the partition includes a bent shape protruded toward the developer storage chamber.

7. The developing device according to claim 4, wherein a free end of the another sheet member is contactable to an inner wall surface of the developer storage chamber in a state that the another sheet member contacts both the plurality of protruding portion and the inner wall surface of the developer storage chamber when the another sheet member rotates with the rotating shaft.

8. The developing device according to claim 1, wherein the plurality of protruding portions is positioned lower than the opening.

9. The developing device according to claim 1, wherein the plurality of protruding portions include a protruding portion overlapping with the opening in an axial direction of the rotating shaft.

10. The developing device according to claim 4, wherein the another sheet member contacts the plurality of protruding portions so that a space is formed between the another sheet member and the partition which forms the opening.

11. A process cartridge removable from an apparatus main body of an electrophotographic image forming apparatus, the cartridge comprising:

an electrophotographic photosensitive member, and the developing device according to claim 1.

12. An electrophotographic image forming apparatus which forms an image on a recording material, the apparatus comprising:

an electrophotographic photosensitive member, and the developing device according to claim 1.

13. An electrophotographic image forming apparatus which forms an image on a recording material, the apparatus comprising the process cartridge removable from the apparatus main body according to claim 11.

14. The developing device according to claim 1, wherein, a fixed end of the sheet member for attaching the sheet member to the rotating shaft is below the free end of the sheet member in the state when the sheet member rotates with the rotating shaft.

15. The developing device according to claim 7, wherein, a fixed end of the sheet member for attaching the sheet member to the rotating shaft is below the free end of the sheet member in the state when the sheet member rotates with the rotating shaft.

* * * * *